US009646538B2

(12) United States Patent
Hasegawa et al.

(10) Patent No.: US 9,646,538 B2
(45) **Date of Patent: *May 9, 2017**

(54) LIGHT EMITTING PERIOD SETTING METHOD, DRIVING METHOD FOR DISPLAY PANEL, DRIVING METHOD FOR BACKLIGHT, LIGHT EMITTING PERIOD SETTING APPARATUS, SEMICONDUCTOR DEVICE, DISPLAY PANEL AND ELECTRONIC APPARATUS

(71) Applicant: Sony Corporation, Tokyo (JP)

(72) Inventors: Hiroshi Hasegawa, Kanagawa (JP); Teppei Isobe, Kanagawa (JP); Hironobu Abe, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/065,445

(22) Filed: Mar. 9, 2016

(65) Prior Publication Data

US 2016/0189637 A1 Jun. 30, 2016

Related U.S. Application Data

(63) Continuation of application No. 14/315,547, filed on Jun. 26, 2014, now Pat. No. 9,361,857, which is a (Continued)

(30) Foreign Application Priority Data

Feb. 8, 2008 (JP) ..... 2008-028628

(51) Int. Cl.
*G09G 3/3258* (2016.01)
*G09G 3/20* (2006.01)
(Continued)

(52) U.S. Cl.
CPC ..... *G09G 3/3258* (2013.01); *G09G 3/2018* (2013.01); *G09G 3/3406* (2013.01);
(Continued)

(58) Field of Classification Search
CPC ..... G09G 5/10; G09G 3/3258; G09G 3/2018; G09G 3/3406; G09G 3/2022;
(Continued)

(56) References Cited

U.S. PATENT DOCUMENTS 4,578,746 A 3/1986 Gyugyi et al.
4,579,746 A 4/1986 Hirose
(Continued)

FOREIGN PATENT DOCUMENTS

JP 07-261696 A 10/1995
JP 11-085100 A 3/1999
(Continued)

OTHER PUBLICATIONS

Japanese Office Action issued Jun. 19, 2012 for corresponding Japanese Application No. 2008-028628.

*Primary Examiner* — Michael Pervan
(74) *Attorney, Agent, or Firm* — Michael Best & Friedrich LLP

(57) ABSTRACT

Disclosed herein is a light emitting period setting method for a display panel wherein the peak luminance level is varied through control of a total light emitting period length which is the sum total of period lengths of light emitting periods arranged in a one-field period, including a step of setting period lengths of N light emitting periods, which are arranged in a one-field period, in response to the total light emitting period length such that the period lengths of the light emitting periods continue to keep a fixed ratio thereamong, N being equal to or higher than 3.

9 Claims, 37 Drawing Sheets

Related U.S. Application Data continuation of application No. 12/320,470, filed on Jan. 27, 2009, now Pat. No. 8,817,012.

(51) Int. Cl.
*G09G 3/34* (2006.01)
*G09G 5/10* (2006.01)

(52) U.S. Cl.
CPC ..... *G09G 5/10* (2013.01); *G09G 2300/0842* (2013.01); *G09G 2300/0861* (2013.01); *G09G 2320/0233* (2013.01); *G09G 2320/0247* (2013.01); *G09G 2320/0261* (2013.01); *G09G 2320/064* (2013.01)

(58) Field of Classification Search
CPC ..... G09G 3/2025; G09G 3/204; G09G 2320/0233; G09G 2320/064; G09G 2320/0247; G09G 2320/0261; G09G 2300/0842; G09G 2300/0861
USPC ..... 345/76–77, 148, 690–693
See application file for complete search history.

(56) References Cited

U.S. PATENT DOCUMENTS

| | | | |
|---|---|---|---|
| 5,128,692 | A | 7/1992 | Reisch |
| 5,619,228 | A | 4/1997 | Doherty |
| 5,757,343 | A | 5/1998 | Nagakubo |
| 6,008,929 | A | 12/1999 | Akimoto et al. |
| 6,100,939 | A | 8/2000 | Kougami et al. |
| 6,181,266 | B1 | 1/2001 | Toki |
| 6,229,506 | B1 | 5/2001 | Dawson et al. |
| 6,529,204 | B1 | 3/2003 | Mikoshiba et al. |
| 6,573,882 | B1 | 6/2003 | Takabayashi |
| 6,831,621 | B2 | 12/2004 | Nakano |
| 7,176,879 | B1 | 2/2007 | Yoshihara et al. |
| 8,537,182 | B2 | 9/2013 | Hasegawa et al. |
| 2006/0028412 | A1 | 2/2006 | Miyagawa |
| 2006/0232717 | A1 | 10/2006 | Kervec et al. |
| 2007/0079191 | A1 | 4/2007 | Shin |
| 2007/0206032 | A1 | 9/2007 | Yamada |
| 2007/0229446 | A1 | 10/2007 | Oh et al. |
| 2007/0247399 | A1 | 10/2007 | Yamashita et al. |
| 2008/0079670 | A1 | 4/2008 | Asano |
| 2008/0094383 | A1 | 4/2008 | Stessen et al. |
| 2008/0165117 | A1 | 7/2008 | Jung et al. |
| 2008/0191642 | A1 | 8/2008 | Slot et al. |
| 2008/0238858 | A1 | 10/2008 | Seong et al. |
| 2008/0303847 | A1 | 12/2008 | Asano |
| 2009/0009850 | A1 | 1/2009 | Shirai et al. |
| 2009/0033686 | A1 | 2/2009 | Asano |
| 2009/0169215 | A1 | 7/2009 | Sauerlander et al. |
| 2010/0020002 | A1 | 1/2010 | Van Woudenberg et al. |

FOREIGN PATENT DOCUMENTS

| | | | |
|---|---|---|---|
| JP | 2002-514320 | A | 5/2002 |
| JP | 2005-027028 | A | 1/2005 |
| JP | 2005-148631 | A | 6/2005 |
| JP | 2006-030516 | A | 2/2006 |
| JP | 2006-053236 | A | 2/2006 |
| JP | 2006-215213 | | 8/2006 |
| JP | 2006-323234 | A | 11/2006 |
| JP | 2007-140503 | A | 6/2007 |
| JP | 2008-525830 | A | 7/2008 |
| JP | 2008-525839 | A | 7/2008 |

RELATED ART

RELATED ART

RELATED ART

RELATED ART

RELATED ART

RELATED ART

RELATED ART

RELATED ART

RELATED ART

RELATED ART

RELATED ART

LIGHT EMITTING PERIOD SETTING METHOD, DRIVING METHOD FOR DISPLAY PANEL, DRIVING METHOD FOR BACKLIGHT, LIGHT EMITTING PERIOD SETTING APPARATUS, SEMICONDUCTOR DEVICE, DISPLAY PANEL AND ELECTRONIC APPARATUS

CROSS REFERENCES TO RELATED APPLICATIONS

This application is a continuation application of application Ser. No. 14/315,547, filed Jun. 26, 2014, which is a Continuation Application of U.S. patent application Ser. No. 12/320,470, filed Jan. 27, 2009, which in turn claims priority from Japanese Patent Application JP 2008-028628 filed in the Japan Patent Office on Feb. 8, 2008, the entire contents of which being incorporated herein by reference.

BACKGROUND OF THE INVENTION

1. Field of the Invention

This invention relates to a control technique for the peak luminance level in a display panel, and more particularly to a light emitting period setting method, a driving method for a display panel, a driving method for a backlight, a light emitting period setting apparatus, a semiconductor device, a display panel and an electronic apparatus.

2. Description of the Related Art

In recent years, development of a display apparatus of the self-luminous type wherein a plurality of organic EL (Electro Luminescence) elements are arranged in rows and columns has proceeded. A display panel which uses organic EL elements also called organic EL panel has superior characteristics that reduction in weight and thickness thereof is easy and that it has a high response speed and is superior in dynamic image picture display characteristic.

Incidentally, driving methods for an organic EL panel are divided into a passive matrix type and an active matrix type. Recently, development of a display panel of the active matrix type wherein an active element in the form of a thin film transistor and a capacitor are arranged for each pixel circuit is proceeding energetically.

FIG. 1 shows an example of a configuration of an organic EL panel ready for a variation function of the light emitting period. Referring to FIG. 1, the organic EL panel 1 shown includes a pixel array section 3, a first control line driving section 5 configured to drive writing control lines WSL, a second control line driving section 7 configured to drive light emitting control lines LSL, and a signal line driving section 9 configured to drive signal lines DTL, arranged on a glass substrate.

The pixel array section 3 has a matrix structure wherein sub pixels 11 of minimum units in a light emitting region are arranged in M rows×N columns. Each of the sub pixels 11 here corresponds, for example, to an R pixel, a G pixel and a B pixel which correspond to three primary colors which form a white unit. The values of M and N depend upon the display resolution in the vertical direction and the display resolution in the horizontal direction.

FIG. 2 shows an example of a pixel circuit of a sub pixel 11 ready for active matrix driving. It is to be noted that many various circuit configurations have been proposed for a pixel circuit of the type described, and FIG. 2 shows a comparatively simpler one of the circuit configurations.

Referring to FIG. 2, the pixel circuit includes a thin film transistor (hereinafter referred to as sampling transistor) T1 for controlling a sampling operation, another thin film transistor (hereinafter referred to as driving transistor) T2 for controlling a supplying operation of driving current, a further thin film transistor (hereinafter referred to as light emitting control transistor) T3 for controlling emission/no-emission of light, a storage capacitor Cs, and an organic EL element OLED (Organic Light-Emitting Diode).

In the pixel circuit of FIG. 2, each of the sampling transistor T1 and the light emitting control transistor T3 is formed from an N-channel MOS transistor, and the driving transistor T2 is formed from a P-channel MOS transistor. At the present point of time, this configuration is possible where a polycrystalline silicon process can be utilized.

It is to be noted that the operation state of the sampling transistor T1 is controlled by the writing control line WSL connected to the gate electrode of the sampling transistor T1. When the sampling transistor T1 is in an on state, a signal potential Vsig corresponding to pixel data is written into the storage capacitor Cs through the signal line DTL. The storage capacitor Cs retains the signal potential Vsig written therein for a period of one field.

The storage capacitor Cs is a capacitive load connected to the gate electrode and the source electrode of the driving transistor T2. Accordingly, the signal potential Vsig stored in the storage capacitor Cs provides a gate-source voltage Vgs of the driving transistor T2, and signal current Isig which corresponds to this gate-source voltage Vgs is written from a current supplying line and supplied to the organic EL element OLED.

It is to be noted that, as the signal current Isig increases, the current flowing to the organic EL element OLED increases and the emission light luminance increases. In other words, a gradation is implemented by the magnitude of the signal current Isig. As long as the supply of the signal current Isig continues, a light emitting state of the organic EL element OLED in a predetermined luminance continues.

However, in the pixel circuit shown in FIG. 2, the light emitting control transistor T3 is connected in series to a supplying path of the signal current Isig. In the circuit configuration of FIG. 2, the light emitting control transistor T3 is connected between the driving transistor T2 and the anode electrode of the organic EL element OLED.

Accordingly, supply and stop of the signal current Isig to the organic EL element OLED are controlled by a switching operation of the light emitting control transistor T3. In particular, the organic EL element OLED emits light only within a period within which the light emitting control transistor T3 is on (the period is hereinafter referred to as "light emitting period"), but emits no light within another period within which the light emitting control transistor T3 is off (the period is hereinafter referred to as "no-light emitting period").

This driving operation can be implemented also by some other pixel circuit. An example of a pixel circuit of the type described is shown in FIG. 3 for reference.

Referring to FIG. 3, the pixel circuit shown includes a sampling transistor T1, a driving transistor T2, a storage capacitor Cs and an organic EL element OLED.

The pixel circuit shown in FIG. 3 and that shown in FIG. 2 are different in presence or absence of the light emitting control transistor T3. In particular, the pixel circuit shown in FIG. 3 does not include the light emitting control transistor T3. Instead, in the pixel circuit shown in FIG. 3, supply and stop of the signal current Isig are controlled by binary value potential driving of the light emitting control line LSL.

More particularly, while the light emitting control line LSL is controlled to a high voltage VDD, the signal current Isig flows to the organic EL element OLED and the organic EL element OLED is controlled to a light emitting state. On the other hand, while the light emitting control line LSL is controlled to a low voltage VSS2 (<VSS1), supply of the signal current Isig to the organic EL element OLED is stopped and the organic EL element OLED is controlled to a no-light emitting state.

In this manner, the operation state of the pixel circuit is controlled through binary value driving of the writing control line WSL and the light emitting control line LSL.

FIGS. 4A to 4C and 5A to 5C illustrate relationships between the potential of the control lines and the operation state of the pixel circuit. It is to be noted that FIGS. 4A to 4C illustrate the relationship where the light emitting period is long while FIGS. 5A to 5C illustrate the relationship where the light emitting period is short.

Incidentally, FIGS. 4A and 5A illustrate the potential of the writing control line WSL, and FIGS. 4B and 5B illustrate the potential of the light emitting control line LSL. Further, FIGS. 4C and 5C illustrate an operation state of the pixel circuit.

As seen in FIGS. 4C and 5C, the light emitting period within a one-field period can be controlled through the light emitting control line LSL.

By combining the control technique for the light emitting period length with an organic EL panel, such various effects as described below can be anticipated.

First, even if the dynamic range of the signal potential Vsig is not varied, the peak luminance level can be adjusted. FIG. 6 illustrates a relationship between the light emitting period length occupying within a one-field period and the peak luminance level.

As a result, also where an input signal to the signal line driving section 9 is given in the form of a digital signal, the peak luminance level can be adjusted without reducing the gradation number of the input signal. Further, in the case of this driving technique, also where the input signal to the signal line driving section 9 is given in an analog form, the maximum amplitude of the input signal need not be reduced. Therefore, the noise resisting property can be enhanced. In this manner, the variation control of the light emitting period length is effective to adjustment of the peak luminance level while high picture quality is maintained.

The variation control of the light emitting period length is advantageous also in that, where the pixel circuit is of the current writing type, the writing current value can be increased to reduce the writing period.

Further, the variation control of the light emitting period length is effective to improve the picture quality of the moving picture image. This effect is described with reference to FIGS. 7 to 9. It is to be noted that the axis of abscissa indicates the position in the screen image and the axis of ordinate indicates the elapsed time. All of FIGS. 7 to 9 represent a movement of a line of sight when an emission line moves in the screen image.

FIG. 7 illustrates a display characteristic of a display apparatus of the hold type wherein the light emitting period is given by 100% of a one-field period represented by 1V in FIG. 7. A representative one of display apparatus of the type just described is a liquid crystal display apparatus.

FIG. 8 illustrates a display characteristic of a display apparatus of the impulse type wherein the light emitting period is sufficiently shorter than a one-field period. A representative one of display apparatus of the type just described is a CRT (Cathode Ray Tube) display apparatus.

FIG. 9 illustrates a display characteristic of a display apparatus of the hold type wherein the light emitting period is limited to 50% of a one-field period.

As can be recognized from comparison of FIGS. 7 to 9, where the light emitting period is 100% of a one-field period as in the case of FIG. 7, a phenomenon that, when a bright spot moves, the display width looks wider, that is, motion blur, is likely to be perceived.

On the other hand, where the light emitting period is sufficiently shorter than a one-field period as in the case of FIG. 8, also when a bright point moves, the display width remains small. In other words, motion blur is not perceived.

However, where the light emitting period is 50% of a one-field period as in the case of FIG. 9, although the display width upon movement of a bright point increases in comparison with that in the case of FIG. 8, the increase of the display width is smaller than that in the case of FIG. 7. Accordingly, motion blur is less likely to be perceived.

Generally it is known that, where the one-field period is given by 60 Hz, if the light emitting period is set longer than 75% of the one-field period, then the moving picture characteristic deteriorates significantly. Therefore, it is considered preferable to suppress the light emitting period to less than 50% of the one-field period.

Different examples of driving timings of a light emitting control line LSL where one light emitting period is included in a one-field period are illustrated in FIGS. 10 and 11. FIG. 10 illustrates an example of driving timings where the light emitting period within a one-field period is 50%, and FIG. 11 illustrates an example of driving timings where the light emitting period within a one-field period is 20%. FIGS. 10 and 11 illustrate the examples of driving timings where the phase relationship exhibits one cycle with 20 lines.

It is to be noted that the light emitting period corresponding to the sth horizontal line from the top of the pixel array section 3 can be represented by the following expression. It is to be noted that the rate of the light emitting period occupying in the one-field period T is represented by DUTY.

In this instance, a light emitting period and a no-light emitting period are given by the following expressions:

Light Emitting Period:

$$\{(s-1)/m\}\cdot T<t<[\{(s-1)/m\}+\mathrm{DUTY}]\cdot T$$

No-Light Emitting Period:

$$[\{(s-1)/m\}+\mathrm{DUTY}]\cdot T<t<|[(s-1)/mJ+1|\cdot T$$

where t satisfies the following period:

$$\{(s-1)/m\}\cdot T<t<[\{(s-1)/m\}+1]\cdot T$$

Related techniques are disclosed in published JP-T-2002-514320, Japanese Patent Laid-Open No. 2005-027028 and Japanese Patent Laid-Open No. 2006-215213.

SUMMARY OF THE INVENTION

However, where a light emitting period and a no-light emitting period are provided within a one-field period, suppression of flickering becomes a new technical subject. Generally, where a one-field period is given by 60 Hz, if the light emitting period is set to less than 25% of the one-field period, then flickering is actualized particularly, and it is considered preferable to set the light emitting period to 50% or more of the one-field period.

In particular, it is known that the light emitting period length within a one-field period is subject to two conflicting restrictions from a point of view of the picture quality of a moving picture image and flickering.

However, with the method in related art wherein only one light emitting period is involved in a one-field period, the restriction to the setting range of the light emitting time length restricts the variation range of the peak luminance level.

Therefore, as a method for reducing perception of flickering also where the light emitting period occupying in the one-field period is short, a method has been proposed wherein the light emitting period to be involved in a one-field period is divided into a plural periods.

FIGS. 12A to 12C and 13 illustrate an example of driving where a light emitting period within a one-field period is divided into two periods including a front half period and a rear half period.

In particular, FIGS. 12A to 12C illustrate a relationship between the potential state of the control lines and the operation state of a pixel circuit, and FIG. 13 illustrates driving timings of the light emitting control line LSL.

In the driving example, the light emission start point of the front half period is set to 0% of a one-field period, and the light emission start point of the rear half period is set to 50% of the one-field period. In other words, the light emission start points are provided fixedly, and the period lengths are variably controlled in response to a total light emitting period length. It is to be noted that the light emitting time lengths in the front half period and the rear half period are set to one half of the total light emitting period length. Accordingly, if the total light emitting time length is 40% of the one-field period, then each of the period lengths is set to 20%.

However, if the driving method illustrated in FIG. 13 is adopted, then where the total light emitting period length is 50% of the one-field period, then a cycle of light emission by 25%→ no-light emission by 25% → light emission by 25%→ no-light emission by 25% is repeated.

The movement of the line of sight in this instance becomes same as the movement of the line of sight in an alternative case wherein 75% of the one-field period are used as a light emitting period as seen in FIG. 14.

In other words, although the driving method wherein a one-field period is divided simply into a front half period and a rear half period can reduce flickering, it has a problem that motion blur is generated newly, resulting in deterioration of the display quality of a moving picture image.

In addition, since the period lengths of the front half period and the rear half period are equal to each other, the driving method described above has a problem also in that movement of one straight line segment is likely to be visually confirmed as movement of two straight line segments.

Therefore, it is desirable to provide a driving technique for a display panel wherein both of motion blur and flickering are suppressed and besides the peak luminance level can be adjusted over a wide range.

A. Setting Method Light Emitting Periods

According to an embodiment of the present invention, there is provided a light emitting period setting method for a display panel wherein the peak luminance level is varied through control of a total light emitting period length which is the sum total of period lengths of light emitting periods arranged in a one-field period, including a step of setting period lengths of N light emitting periods, which are arranged in a one-field period, in response to the total light emitting period length such that the period lengths of the light emitting periods continue to keep a fixed ratio thereamong, N being equal to or higher than 3.

Preferably, the number N of the light emitting periods is an odd number. However, the number N of the light emitting periods may otherwise be an even number.

Preferably, the period lengths of the N light emitting periods are set such that the period length of the light emitting period allocated to any of the N light emitting periods which is comparatively near to the center of the array of the N light emitting periods has a comparatively high rate. Naturally, by setting a comparatively high rate to a light emitting period which is positioned comparatively near to the center of the array, the visual confirmation luminance of a light emitting period in the proximity of the center of the array can be set higher than that at peripheral positions.

In particular, also where the peak luminance level is controlled over a wide range, a light emitting period or periods which are visually confirmed principally can be concentrated in the proximity of the center of the variation range. As a result, an image can be made less likely to be visually observed as multiple overlapping images, and the picture quality when a moving picture is displayed can be maintained in a high picture quality state.

Preferably, the N light emitting periods are merged into a single light emitting period when the total light emitting period length reaches a maximum value therefor. This signifies that, during a process until the total light emitting period reaches the maximum value, the light emitting periods are merged into one light emitting period.

Preferably, the opposite ends of the N light emitting periods are always fixed to positions of outer edges of no-light emitting periods where the total light emitting period length reaches a maximum value therefor. However, the opposite ends of the N light emitting periods may not necessarily be fixed to the positions of the outer edges of the no-light emitting periods if the N light emitting periods are set within a range on the inner side with respect to the no-light emitting periods where the total light emitting period length reaches a maximum value therefor.

Anyway, the variation range of the light emitting periods can be limited to a fixed range within a one-field period. Accordingly, the extent of the light emitting range grasped visually can be limited to the fixed range, and motion blur can be prevented from being visually confirmed.

Preferably, the period lengths of no-light emitting periods positioned in gaps between the light emitting periods are set such that the period length of the no-light emitting period allocated to any of the no-light emitting periods which is comparatively near to any of the opposite ends of the array of the N light emitting periods has a comparatively high rate. In this instance, those light emitting periods which have a comparatively large period length can be concentrated in the proximity of the center in the variation range of the light emitting periods. Consequently, motion blur can be prevented further from being visually confirmed.

However, the period lengths of no-light emitting periods positioned in gaps between the light emitting periods may be set so as to be equal to each other. In this instance, the light emitting periods can be arranged uniformly within the variation range of the light emitting periods.

B. Driving Method for Display Panel

According to another embodiment of the present invention, there is provided a driving method for a display panel wherein the peak luminance level is varied through control of a total light emitting period length which is the sum total of period lengths of light emitting periods arranged in a one-field period, including the steps of setting period lengths of N light emitting periods, which are arranged in a one-field period, in response to the total light emitting period length such that the period lengths of the light emitting periods continue to keep a fixed ratio thereamong, N being equal to or higher than 3, and driving a pixel array section of the display panel so that the set period lengths may be implemented.

C. Driving Method for Backlight

According to a further embodiment of the present invention, there is provided a driving method for a backlight of a display panel wherein the peak luminance level is varied through control of a total light emitting period length which is the sum total of period lengths of light emitting periods arranged in a one-field period, including the steps of setting period lengths of N light emitting periods, which are arranged in a one-field period, in response to the total light emitting period length such that the period lengths of the light emitting periods continue to keep a fixed ratio thereamong, N being equal to or higher than 3, and driving the backlight so that the set period lengths may be implemented.

D. Light Emitting Period Setting Apparatus and other Apparatus

According to a still further embodiment of the present invention, there is provided a light emitting period setting apparatus including a light emitting period setting section configured to set period lengths of N light emitting periods, which are arranged in a one-field period, in response to a total light emitting period length, which is the sum total of period lengths of light emitting periods arranged in a one-field period, such that the period lengths of the light emitting periods continue to keep a fixed ratio thereamong, N being equal to or higher than 3. The light emitting period setting apparatus may be formed on a semiconductor substrate or on an insulating substrate. The light emitting period setting apparatus preferably is a semiconductor device.

E. Display Panel 1

According to a yet further embodiment of the present invention, there is provided a display panel wherein the peak luminance level is variably controlled through control of a total light emitting period length which is the sum total of period lengths of light emitting periods arranged in a one-field period, including (a) a pixel array section having a pixel structure ready for an active matrix driving method, (b) a light emitting period setting section configured to set period lengths of N light emitting periods, which are arranged in a one-field period, in response to the total light emitting period length such that the period lengths of the light emitting periods continue to keep a fixed ratio thereamong, N being equal to or higher than 3, and (c) a panel driving section configured to drive the pixel array section so that the set period lengths may be implemented.

The pixel array section may have a pixel structure wherein a plurality of EL elements are arranged in a matrix, and the panel driving section may set the light emitting period of the EL elements.

F. Display Panel 2

According to a yet further embodiment of the present invention, there is provided a display panel wherein the peak luminance level is variably controlled through control of a total light emitting period length which is the sum total of period lengths of light emitting periods arranged in a one-field period, including (a) a pixel array section having a pixel structure ready for an active matrix driving method, (b) a light emitting period setting section configured to set arrangement positions and period lengths of N light emitting periods, which are arranged in a one-field period, in response to the total light emitting period length such that the period lengths of the light emitting periods continue to keep a fixed ratio thereamong, N being equal to or higher than 3, and (c) a backlight driving section f configured to drive a backlight light source so that the set period lengths may be implemented.

G. Electronic Apparatus

According to a yet further embodiment of the present invention, there are provided electronic apparatus which individually incorporate the two different display panels described above and further include a system control section configured to control the panel driving section, and an operation inputting section configured to input an operation to the system control section.

Where the driving technique proposed as above is adopted, even where three or more light emitting periods are arranged within a one-field period, a luminance difference can be produced between a light emitting period which is used as the center of light emission and the other light emitting periods.

In other words, a luminance difference between an image to be visually confirmed principally and the other images can be made clear. As a result, a multiple overlapping phenomenon of images of similar luminance which make a cause of motion blur can be reduced. Consequently, even where the peak luminance level is adjusted over a wide range, deterioration of the picture quality can be suppressed.

DETAILED DESCRIPTION OF THE PREFERRED EMBODIMENTS

In the following, embodiments of the present invention are described in detail in connection with an organic EL panel of the active matrix driving type to which the present invention is applied.

It is to be noted that, for technical matters which are not specifically described herein or specifically illustrated in the accompanying drawings, techniques which are known in the pertaining technical field are applied.

A. Appearance Structure of Organic EL Panel

In the present specification, not only a display panel wherein a pixel array section and a driving circuit such as, a control line driving section and a signal line driving section are formed on the same substrate but also another display panel wherein a driving circuit fabricated as an IC for a particular application is mounted on a substrate on which a pixel array section is mounted commonly are referred to as display panel.

Figure 15:
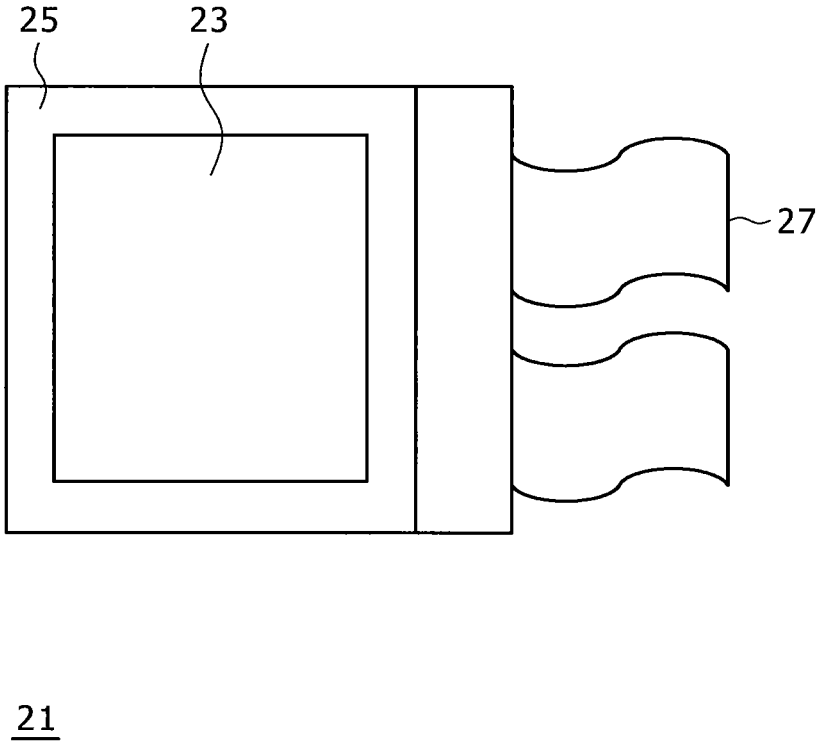
FIG. 15 is a schematic view showing an appearance configuration of an organic EL panel.

FIG. 15 shows an example of an appearance of an organic EL panel. Referring to FIG. 15, the organic EL panel 21 shown is structured such that an opposing substrate 25 is adhered to a support substrate 23.

The support substrate 23 is made of glass, plastics or some other suitable material. Where the organic EL panel adopts a top emission system as a light emission system thereof, pixel circuits are formed on the surface of the support substrate 23. In other words, the support substrate 23 corresponds to a circuit board.

On the other hand, where the organic EL panel adopts the bottom emission system as a light emission system thereof, organic EL elements are formed on the surface of the support substrate 23. In other words, the support substrate 23 corresponds to a sealing substrate.

Also the opposing substrate 25 is made of glass, plastics or some other transparent material. The opposing substrate 25 seals the surface of the support substrate 23 with the sealing member held therebetween. It is to be noted that, where the organic EL panel adopts the top emission system as the light emitting system thereof, the opposing substrate 25 corresponds to a sealing substrate. On the other hand, where the organic EL panel adopts the bottom emission system as the light emission system thereof, the opposing substrate 25 corresponds to a circuit board.

It is to be noted that the transparency of a substrate may be assured only on the light emitting side, but the other substrate may be an opaque substrate.

Further, a flexible printed circuit (FPC) 27 for inputting an external signal or a driving power supply is arranged on the organic EL panel 21 as occasion demands.

B. Embodiment 1

B-1. System Configuration

Figure 16:
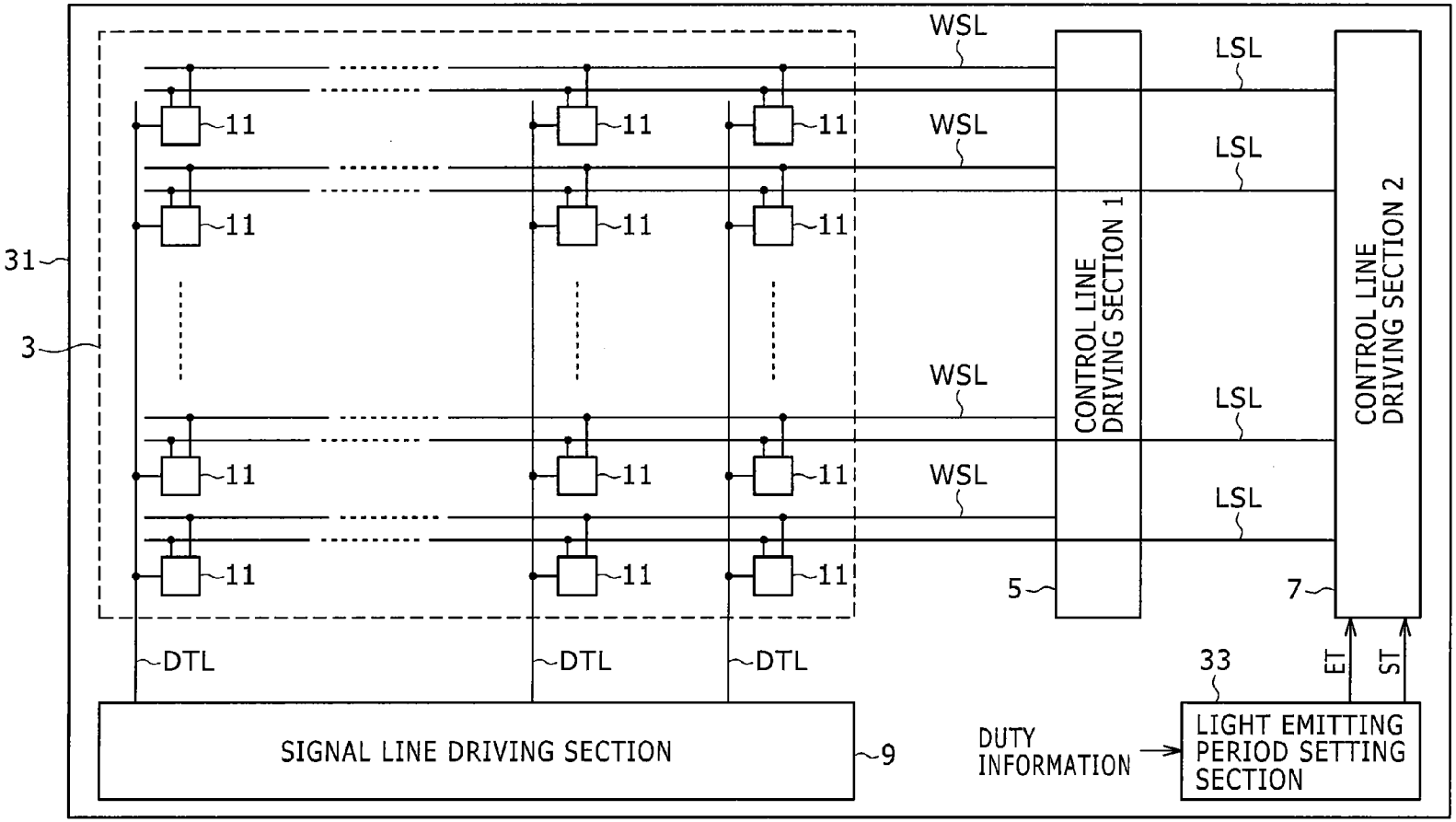
FIG. 16 is a block diagram showing an example of a system configuration of the organic EL panel of FIG. 15.

FIG. 16 shows an example of a system configuration of an organic EL panel 31 according to an embodiment of the present invention.

The organic EL panel 31 includes a pixel array section 3, a first control line driving section 5 configured to drive writing control lines WSL, a second control line driving section 7 configured to drive light emitting control lines LSL, a signal line driving section 9 configured to drive signal lines DTL and a light emitting period setting section 33 configured to set a light emitting period, arranged on a glass substrate.

Figure 1:
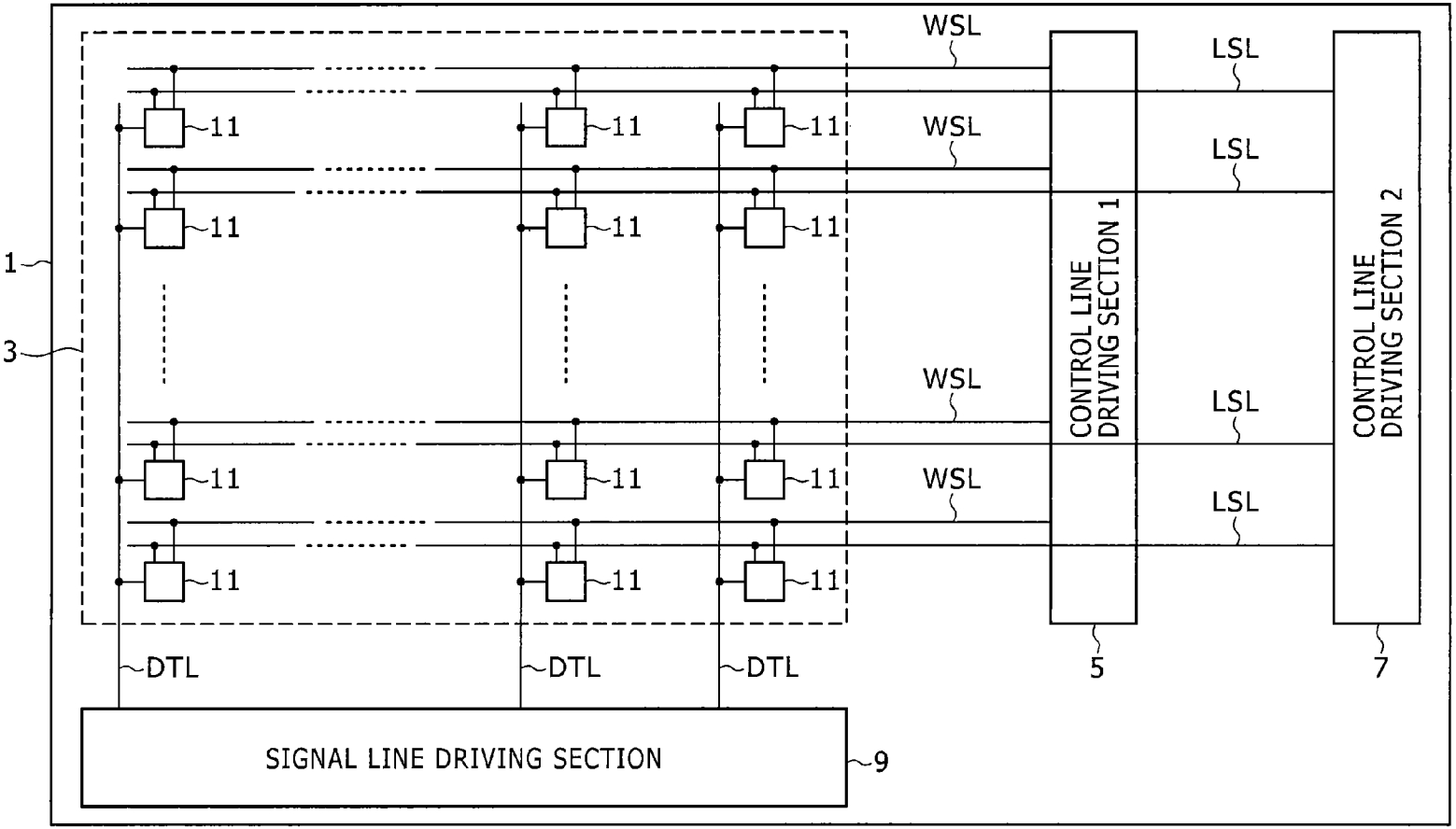
FIG. 1 is a block diagram showing an example of a general configuration of an organic EL panel in related art.

In short, the system configuration of the organic EL panel 31 is similar to that described hereinabove with reference to FIG. 1 except the light emitting period setting section 33.

In the following, a function of the light emitting period setting section 33 which is a unique component in the present embodiment is described.

The light emitting period setting section 33 receives a total light emitting period length within a one-field period, that is, DUTY information, from the outside. It is to be noted that, where the number of light emitting periods arranged in a one-field period is one, the total light emitting period length is equal to the length of the one-field period, but where the number of light emitting periods arranged in a one-field period is a plural number, the total light emitting period length is equal to the sum total of the lengths of the periods.

In any case, the total light emitting period length is information for adjustment of the peak luminance level and is supplied from a system configuration section not shown or the like. It is to be noted that the total light emitting period length is given not only as a preset value upon shipment of the product but also as a value which reflects a user operation such as, an operation for adjusting the brightness of the screen image.

Further, the total light emitting period length is successively set to an optimum value, for example, in response to the type of an image to be displayed such as a still picture type image, a moving picture type image, a text type image, a movie image or a television program image, the brightness of external light, the panel temperature and so forth.

The term "still picture type image" is used so as to signify an image which principally is a still picture. The term "moving picture type image" is used so as to signify an image which principally is a moving picture. Further, the term "text type image" is used to signify an image which principally is a text image.

The system control section not shown arbitrates the functions taking an influence to be had on the picture quality into consideration to successively determine an optimum total light emitting period length in accordance with a program determined in advance. The total light emitting period length determined in this manner is supplied to the light emitting period setting section 33. It is to be noted that the system control section is incorporated in or externally connected to the organic EL panel 31.

The light emitting period setting section 33 arranges a plurality of light emitting periods in a one-field period so that the total light emitting period length or DUTY information supplied thereto may be satisfied. In particular, the light emitting period setting section 33 executes a process of setting the arrangement position and the period length for each of the light emitting periods and another process of generating driving pulses, that is, a start pulse ST and an end pulse ET, so that the pixel array section 3 may be driven actually in accordance with the set conditions.

Although particular examples of a setting method for light emitting periods are hereinafter described, the light emitting period setting section 33 operates such that a number of light emitting periods set or indicated in advance are arranged within a one-field period. Further, the light emitting period setting section 33 variably controls the period length of a particular light emitting period and the other light emitting periods such that the particular light emitting period may come to the center of light emission.

It is to be noted that, in the particular examples hereinafter described, the timings of the light emitting periods are determined such that the time length from a start timing of a light emitting period which appears first within a one-field period to an end timing of another light emitting period which appears last in the one-field period, that is, an apparent light emitting period length, may be equal to or longer than 25% but equal to or shorter than 75% of the one-field period. The reason is that it is intended to achieve compatibility of reduction of flickering and reduction of motion blur.

Figure 17:
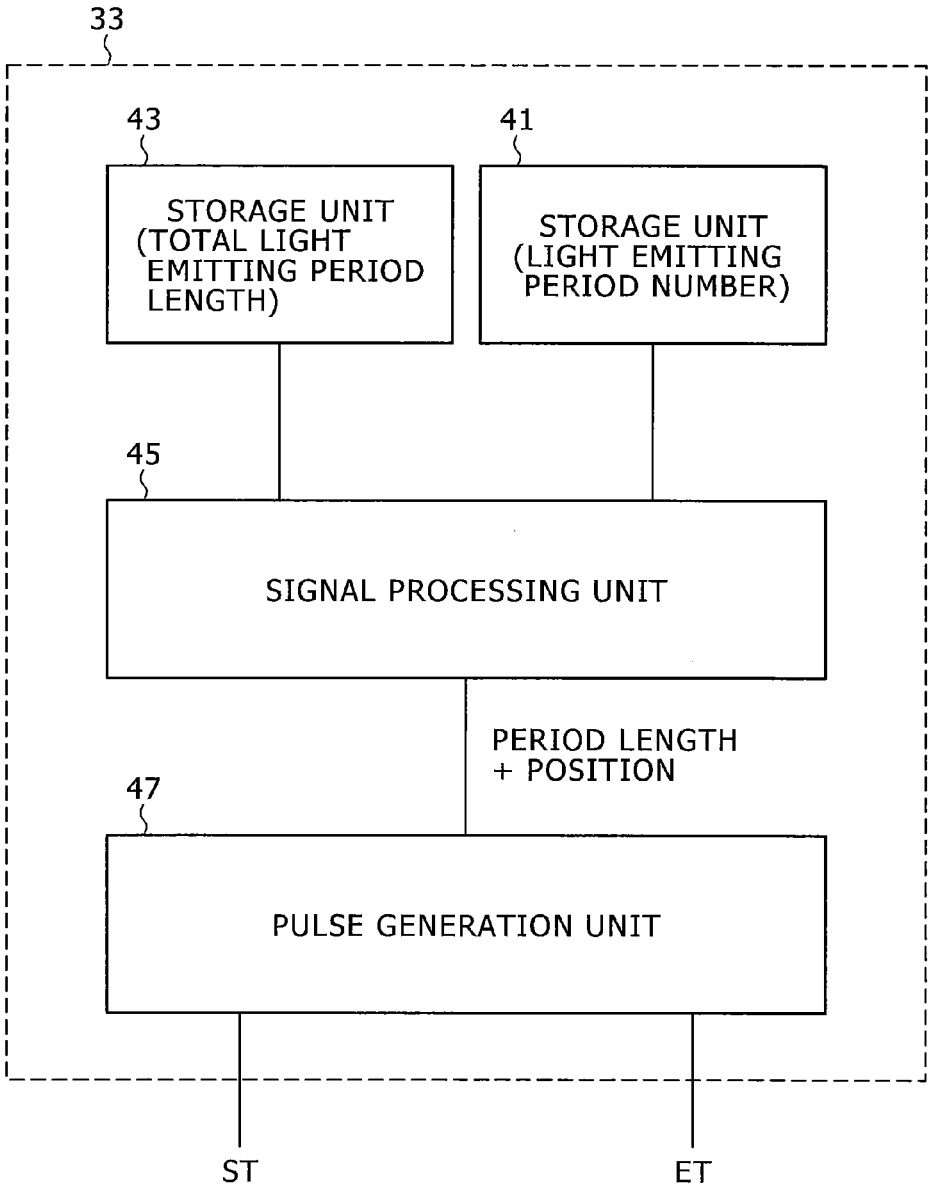
FIG. 17 is a block diagram showing an example of an internal configuration of a light emitting period setting section shown in FIG. 16.

FIG. 17 shows an internal configuration of the light emitting period setting section 33. Referring to FIG. 17, the light emitting period setting section 33 includes a storage unit 41 for storing a light emitting period number N set in advance, a storage unit 43 for storing a total light emitting period length or DUTY information supplied thereto from the outside, a signal processing unit 45 for calculating the period length and the arrangement position of each light emitting period based on the information from the storage unit 41 and the storage unit 43, and a pulse generation unit 47 for generating driving pulses including a start pulse ST and an end pulse ET which satisfy the calculated period length and arrangement position of the light emitting period.

It is to be noted that an example of calculation of a period length and an arrangement position by the signal processing unit 45 is hereinafter described. However, calculation of a period length and an arrangement position by the signal processing unit 45 may be executed only when the total light emitting period length or the number of light emitting periods is changed. Accordingly, the light emitting period setting section 33 preferably has a storage unit for storing a result of calculation.

B-2. Example of Setting of Light Emitting Periods

In the following, particular examples of setting of light emitting periods by the light emitting period setting section 33 are described. It is to be noted that a start timing and an end timing of each light emitting period are implemented by a process of a digital processor (DSP) or a logic circuit ready for a calculation expression hereinafter given.

It is to be noted that, in the setting examples given below, it is assumed that a television signal is inputted as a display image. In other words, it is assumed that the frame rate of a display image is given as 50 Hz or 60 Hz.

Also it is to be noted that the period length of each light emitting period is set such that the center of light emission becomes the center of a variation range of the light emitting period length.

Further, the period length of each light emitting period is set in response to the total light emitting period length provided from the outside such that it may satisfy a ratio set in advance.

Accordingly, in the setting examples given below, a rate is allocated to each of N light emitting periods such that a higher rate is allocated to a light emitting period which is nearer to a central one of the N light emitting periods.

In other words, the rate is set such that a light emitting period nearer to the center of the array of the light emitting periods has a longer light emitting period but a light emitting period nearer to each end of the array has a shorter light emitting period.

This makes it likely for a user to visually confirm the bright regions within a one-field period as a single bright region.

Further, in the following setting examples, even if the total light emitting period length varies, the relationship of the period lengths of the light emitting periods always satisfies a fixed ratio.

Accordingly, the manner in which a bright region looks can be made fixed independently of the total light emitting period length, and such a situation that the user may have an unfamiliar feeling can be prevented.

Further, in the setting examples, the start timing of a light emitting period which appears first within a one-field period and the end timing of another light emitting period which appears last within the one-field period are set fixedly in response to a maximum value of the total light emitting period length.

In particular, where the entire one-field period is represented by 100%, the start timing of the light emitting period which appears first is set to 0%, and the end timing of the light emitting period which appears last is set to the maximum value of the total light emitting period.

In the following, several particular examples are described successively. It is to be noted that, while the rates to be allocated to the individual light emitting periods in the following are set in advance, preferably they can be changed by control from the outside.

B-3. Example of Setting where Light Emitting Period Number N is Odd Number

First, setting examples wherein the light emitting period number N is an odd number equal to or higher than 3 are described.

It is to be noted that the inventors of the present invention considers preferable to set the light emitting period number N to 5, 7 or 9 taking the circuit scale, the scale of calculation processing, achieved effects and so forth into consideration.

a. Particular Example 1 (N=3)

Here, a setting example wherein the light emitting period number N is 3 is described. It is assumed that the period length of the light emitting periods is set to a ratio of 1:2:1 in the appearing order of them.

FIGS. 18A to 18D and 19A to 19D illustrate arrangement of the light emitting periods in this instance and a variation of the period lengths by variation of the total light emitting period.

It is to be noted that FIGS. 18A to 18D and 19A to 19D illustrate the arrangement and the variation described above in a case wherein the maximum value of the total light emitting period length is set to 60% of a one-field period. Therefore, the light emitting periods are varied within a range from 0% to 60% of a one-field period. Further, the range from 60% to 100% of each one-field period is normally set to a no-light emitting period. The presence of such a fixed non-light emitting period as just described is essentially required in order to raise the visibility of a moving picture.

As a result, the start timing of the first light emitting period is fixed to 0%, and the end timing of the third light emitting period is fixed to 60%.

It is to be noted that, in the case of the present setting example, the no-light emitting periods arranged between the light emitting periods are set so as to have an equal length as seen in FIGS. 19A to 19D.

In this instance, if the total light emitting period length increases, then the period lengths of the light emitting periods vary so as to be leftwardly and rightwardly symmetrical with respect to the point of 30% within the one-field period which is the center of the variation range.

Figures 18A, 18B, 18C, 18D:
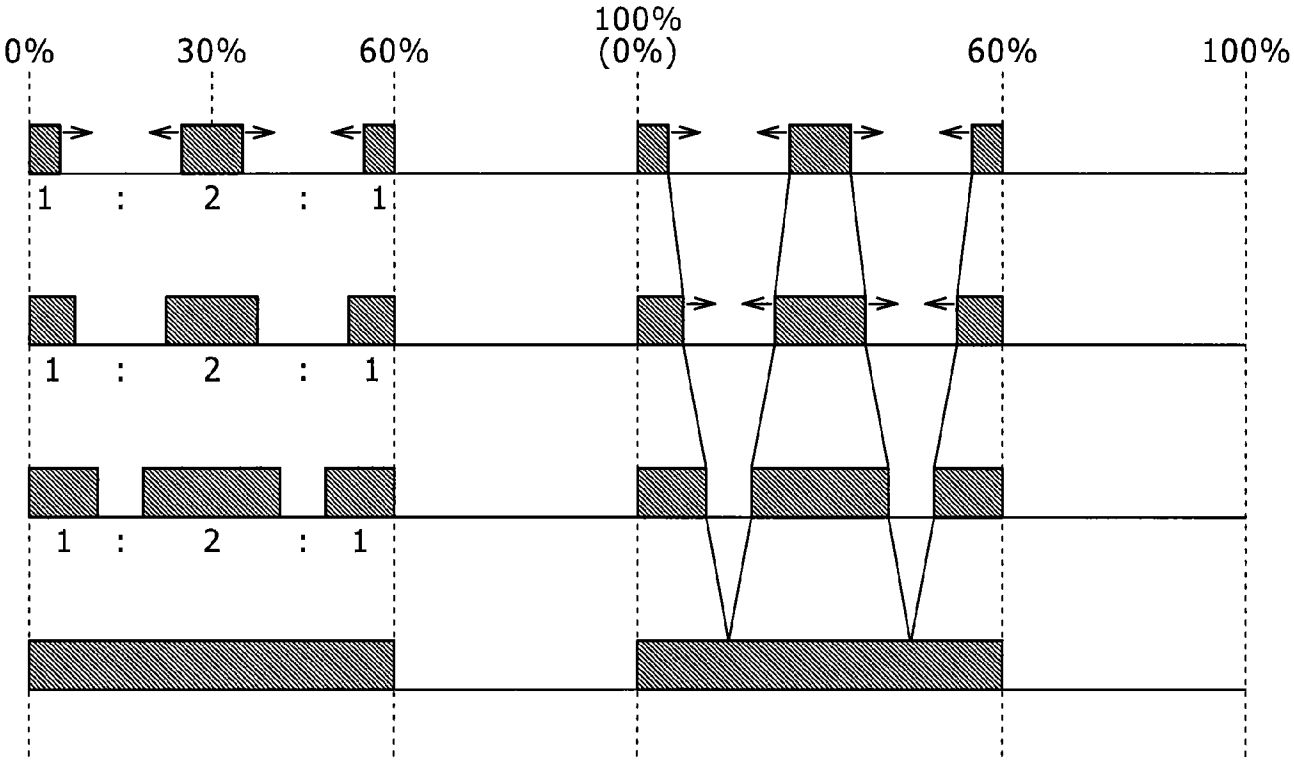
FIGS. 18A to 18D, 19A to 19D, 20A to 20D, 21A to 21D, 22A to 22D, 23A to 23D, 24A to 24C and 25A to 25C are timing charts illustrating different examples of driving timings of the organic EL panel of FIG. 16 where the number of light emitting periods is an odd number.
Figures 19A, 19B, 19C, 19D:
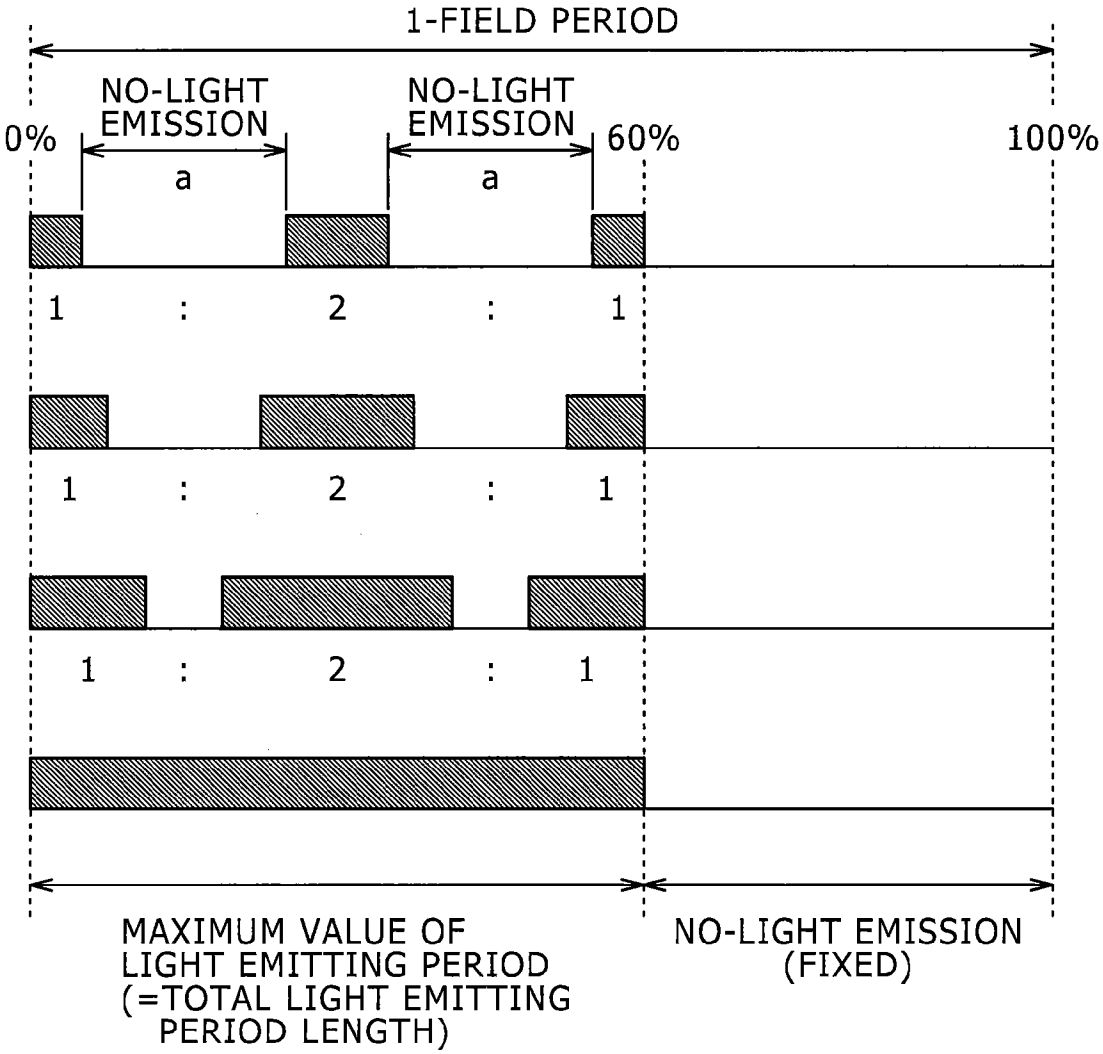

Naturally, the period lengths of the light emitting periods vary in a state wherein the ratio of 1:2:1 is kept satisfied. Then, if the total light emitting period length reaches its maximum value, then all of the light emitting periods become a unified single light emitting period as seen in FIG. 18D.

At this time, if it is assumed that the total light emitting period is given by A % of a one-field period, then the light emitting periods and the no-light emitting periods are given by the expressions give below.

In the following description, the period length of the first and third light emitting periods is represented by T1 and that of the second light emitting periods is represented by T2. Further, the period length of the no-light emitting periods is represented by T3.

$$T1=A\ \%/4$$

$$T2=A\ \%/2$$

$$T3=(60\%-A\ \%)/2$$

For example, if the total light emitting period length is 40% of a one-field period, then the period lengths are calculated in the following manner:

$$T1=40\%/4=10\%$$

$$T2=40\%/2=20\%$$

$$T3=(60\%-40\%)/2=10\%$$

As a result, where the start timing and the end timing of each light emitting period are represented by (X %, Y %), the arrangement positions of the light emitting periods are set in the following manner:

First light emitting period: (0%, 10%)

Second light emitting period: (20%, 40%)

Third light emitting period: (50%, 60%)

It is to be noted that, as described hereinabove, where the total light emitting period length is 60% of a one-field period, the only one light emitting period is set as (0%, 60%).

Further, in the case of the particular example 1, 60% of a one-field period are set as an apparent appearance range of a light emitting period. Therefore, basically flickering is not perceived.

As a result, a light emitting period which provides reduced flickering to assure enhanced picture quality of a moving picture image can be set.

b. Particular Example 2 (N=3)

Now, a setting example wherein the light emitting period number N is 3 is described. It is to be noted that, in the present particular example, the period length of the light emitting periods is set to a ratio of 1:5:1 in the appearing order of them.

FIGS. 20A to 20D illustrate arrangement of the light emitting periods in this instance and a variation of the period lengths by variation of the total light emitting period.

Also FIGS. 20A to 20D illustrate the arrangement and the variation described above in a case wherein the maximum value of the total light emitting period length is set to 60% of a one-field period. Therefore, the light emitting periods are varied within a range from 0% to 60% of a one-field period. Further, the range from 60% to 100% of each one-field period is normally set to a no-light emitting period.

Accordingly, the start timing of the first light emitting period is fixed to 0%, and the end timing of the third light emitting period is fixed to 60%.

It is to be noted that, in the case of the present setting example, the no-light emitting periods arranged between the light emitting periods are set so as to have an equal length as seen in FIGS. 20A to 20D.

In this instance, if the total light emitting period length increases, then the period lengths of the light emitting periods vary so as to be leftwardly and rightwardly symmetrical with respect to the point of 30% within the one-field period which is the center of the variation range.

Figures 20A, 20B, 20C, 20D:
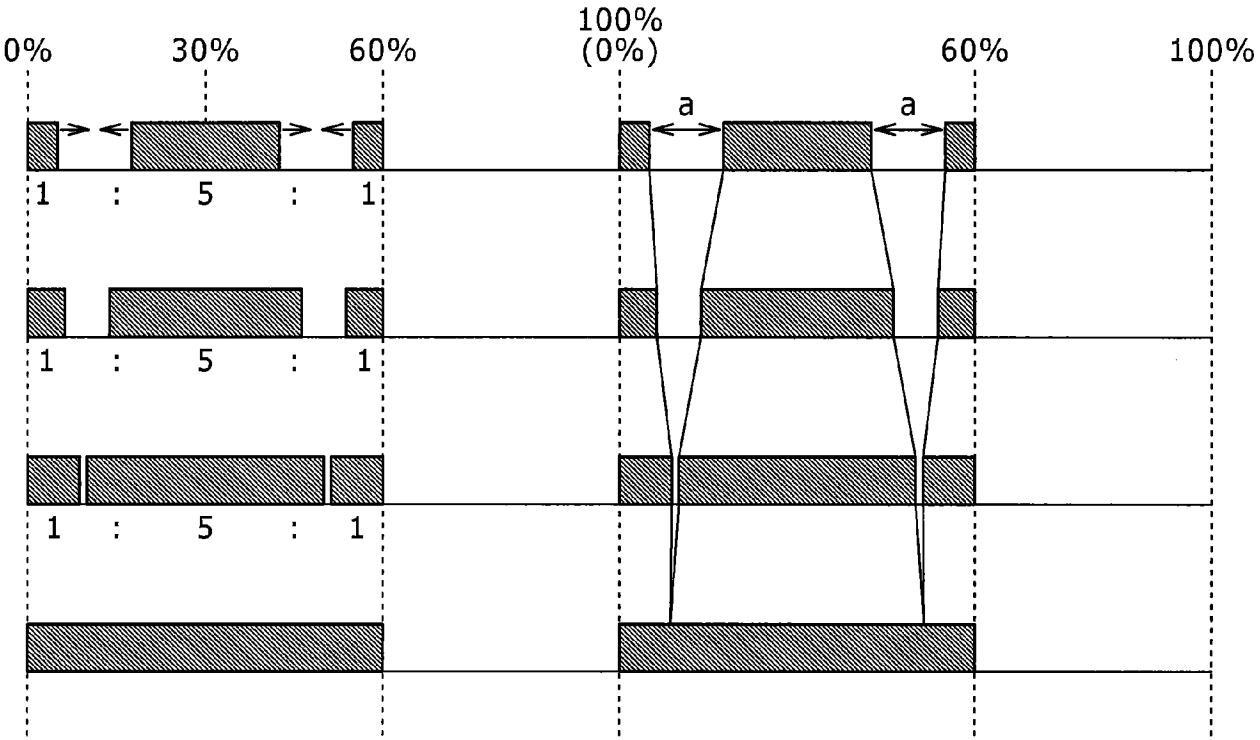

Naturally, the period lengths of the light emitting periods vary in a state wherein the ratio of 1:5:1 is kept satisfied. Then, if the total light emitting period length reaches its maximum value, then all of the light emitting periods become a unified single light emitting period as seen in FIG. 20D.

At this time, if it is assumed that the total light emitting period is given by A % of a one-field period, then the light emitting periods and the no-light emitting periods are given by the expressions give below.

In the following description, the period length of the first and third light emitting periods is represented by T1 and that of the second light emitting periods is represented by T2. Further, the period length of the no-light emitting periods is represented by T3.

$$T1=A\ \%/7$$

$$T2=(A\ \%/7)*5$$

$$T3=(60\%-A\ \%)/2$$

For example, if the total light emitting period length is 40% of a one-field period, then the period lengths are calculated in the following manner:

$$T1=40\%/7=5.7\%$$

$$T2=(40\%/7)*5=28.5\%$$

$$T3=(60\%-40\%)/2=10\%$$

As a result, where the start timing and the end timing of each light emitting period are represented by (X %, Y %), the arrangement positions of the light emitting periods are set in the following manner:

First light emitting period: (0%, 5.7%)

Second light emitting period: (15.7%, 44.2%)

Third light emitting period: (54.3%, 60%)

In this manner, in the case of the particular example 2, the luminance difference between a region corresponding to the second time light emitting period and regions corresponding to light emitting periods positioned on the opposite sides of the second time light emitting period can be made greater than that in the particular example 1. As a result, the region which is perceived principally can be concentrated on the second light emitting period. As a result, motion blur is less likely to appear, and the visibility of a moving picture image can be enhanced further.

It is to be noted that, as described hereinabove, where the total light emitting period length is 60% of a one-field period, the only one light emitting period is set as (0%, 60%).

Further, also in the case of the particular example 2, 60% of a one-field period are set as an apparent appearance range of a light emitting period. Therefore, basically flickering is not perceived.

As a result, a light emitting period which provides reduced flickering to assure enhanced picture quality of a moving picture image can be set.

c. Particular Example 3 (N=5)

Here, a setting example wherein the light emitting period number N is 5 is described. In the present particular example, the period length of the light emitting periods is set to a ratio of 1:1.5:3:1.5:1 in the appearing order of them.

FIGS. 21A to 21D illustrate arrangement of the light emitting periods in this instance and a variation of the period lengths by variation of the total light emitting period.

FIGS. 21A to 21D illustrate the arrangement and the variation described above in a case wherein the maximum value of the total light emitting period length is set to 75% of a one-field period. Therefore, the light emitting periods are varied within a range from 0% to 75% of a one-field period. Further, the range from 75% to 100% of each one-field period is normally set to a no-light emitting period.

Accordingly, in the case of the present particular example, the start timing of the first light emitting period is fixed to 0%, and the end timing of the fifth light emitting period is fixed to 75%.

It is to be noted that, also in the case of the present setting example, the no-light emitting periods arranged between the light emitting periods are set so as to have an equal length as seen in FIGS. 21A to 21D.

In this instance, if the total light emitting period length increases, then the period lengths of the light emitting periods vary so as to be leftwardly and rightwardly symmetrical with respect to the point of 37.5% within the one-field period which is the center of the variation range.

Figures 21A, 21B, 21C, 21D:
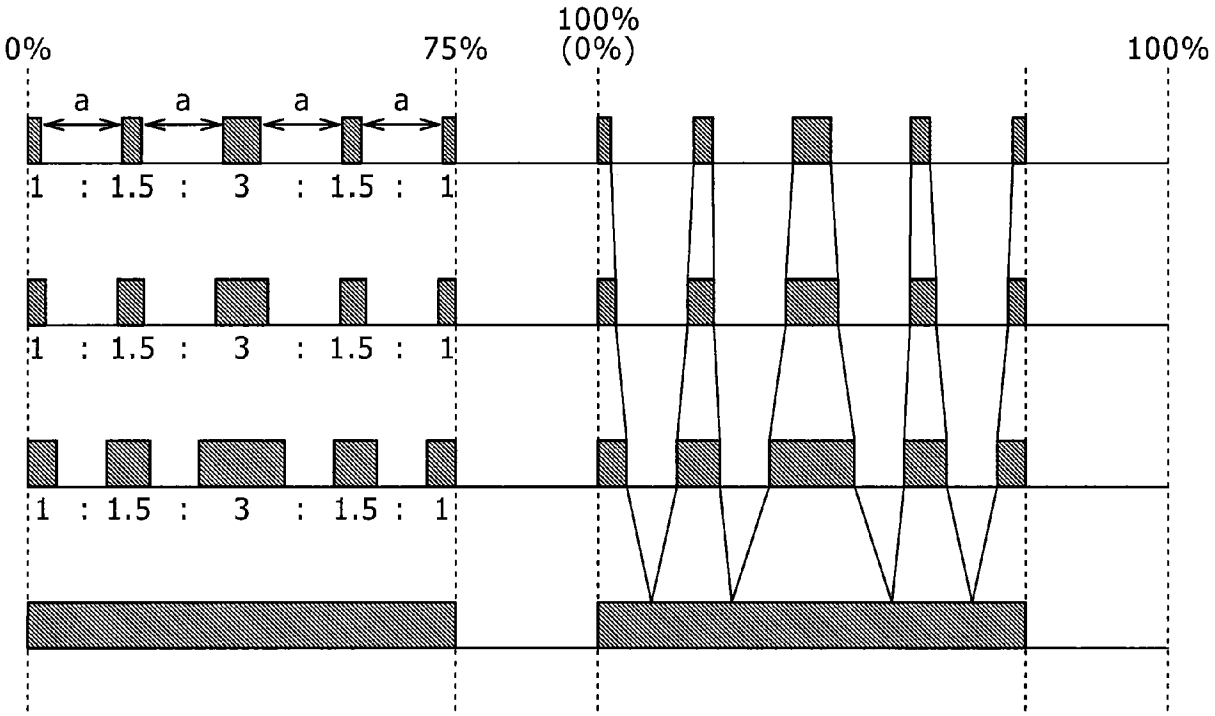
Figures 22A, 22B, 22C, 22D:
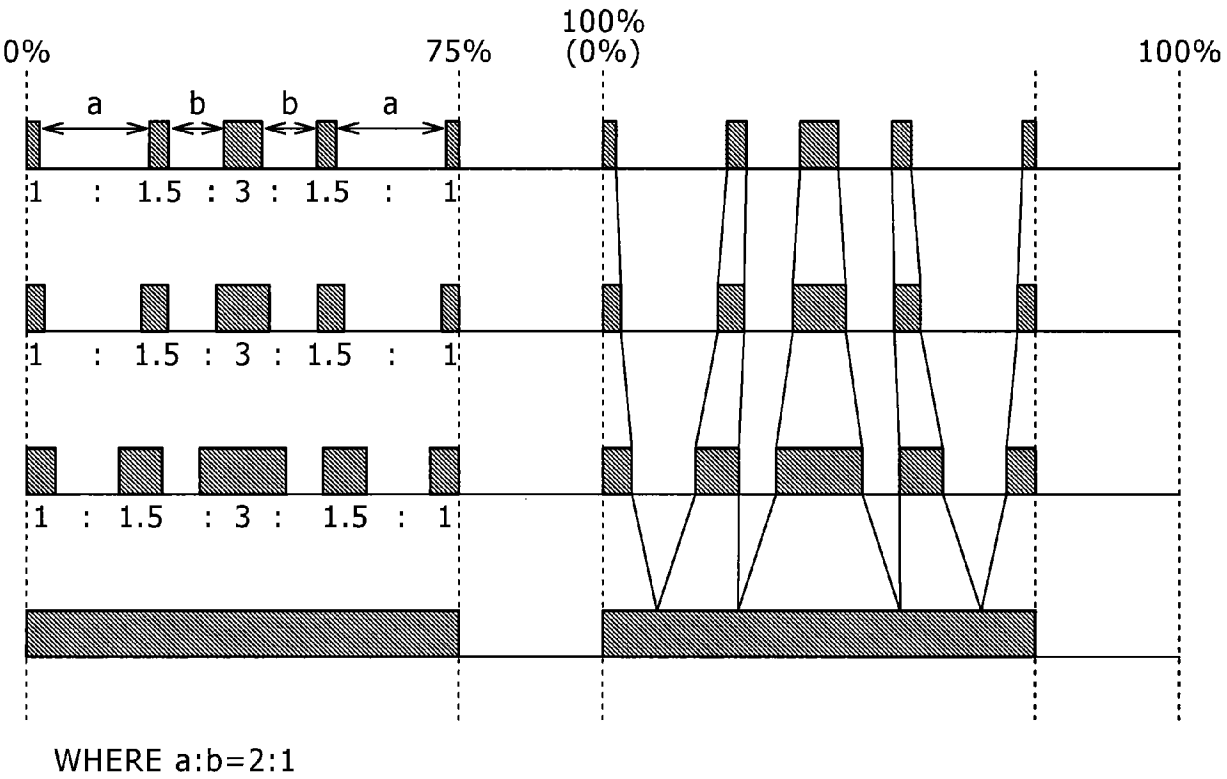
Figures 23A, 23B, 23C, 23D:
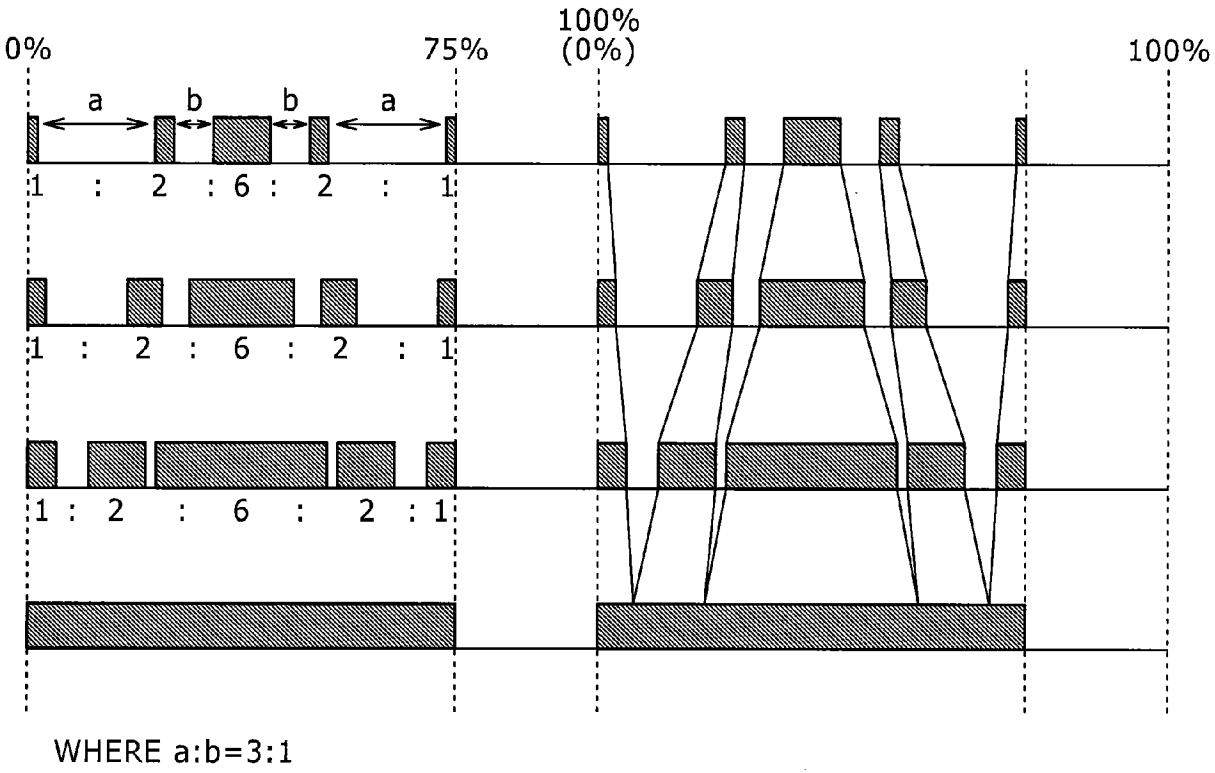

Naturally, the period lengths of the light emitting periods vary in a state wherein the ratio of 1:1.5:3:1.5:1 is kept satisfied. Then, if the total light emitting period length reaches its maximum value, then all of the light emitting periods become a unified single light emitting period as seen in FIG. 21D.

At this time, if it is assumed that the total light emitting period is given by A % of a one-field period, then the light emitting periods and the no-light emitting periods are given by the expressions give below.

In the following description, the period length of the first and fifth light emitting periods is represented by T1 and that of the second and fourth light emitting periods is represented by T2 while the period length of the third light emitting period is represented by T3. Further, the period length of the no-light emitting periods is represented by T4.

$$T1=A\ \%/8$$

$$T2=(A\ \%/8)*1.5$$

$$T3=(A\ \%/8)*3$$

$$T4=(75\%-A\ \%)/4$$

For example, if the total light emitting period length is 40% of a one-field period, then the period lengths are calculated in the following manner:

$$T1=40\%/8=5\%$$

$$T2=(40\%/8)*1.5=7.5\%$$

$$T3=(40\%/8)*3=15\%$$

$$T4=(75\%-40\%)/4=8.75\%$$

As a result, where the start timing and the end timing of each light emitting period are represented by (X %, Y %), the arrangement positions of the light emitting periods are set in the following manner:

First light emitting period: (0%, 5%)

Second light emitting period: (13.75%, 21.25%)

Third light emitting period: (30%, 45%)

Fourth light emitting period: (53.75%, 61.25%)

Fifth light emitting period: (70%, 75%)

In this manner, in the case of the particular example 3, the period lengths can be set such that the third light emitting period exhibits the largest luminance area and the light emitting periods positioned on the opposite sides of the third light emitting period exhibits the third largest luminance area while the light emitting periods positioned on the opposite sides of the second and fourth light emitting periods exhibit the smallest luminance area. As a result, the region which is perceived principally can be concentrated on the third light emitting period and the two light emitting periods on the opposite sides of the third light emitting period. As a result, motion blur is less likely to appear, and the visibility of a moving picture image can be enhanced further.

It is to be noted that, as described hereinabove, where the total light emitting period length is 75% of a one-field period, the only one light emitting period is set as (0%, 75%).

Further, also in the case of the particular example 3, 75% of a one-field period are set as an apparent appearance range of a light emitting period. Therefore, basically flickering is not perceived.

As a result, a light emitting period which provides reduced flickering to assure enhanced picture quality of a moving picture image can be set.

d. Particular Example 4 (N=5)

Also here, a setting example wherein the light emitting period number N is 5 is described. Also in the present particular example, the period length of the light emitting periods is set to a ratio of 1:1.5:3:1.5:1 in the appearing order of them similarly as in the case of the particular example 3.

The particular example 4 and the particular example 3 are different from each other in the method of providing time lengths of no-light emitting periods.

In the case of the particular example 3, all of the period lengths of the no-light emitting periods positioned between the light emitting periods are set equal to each other.

However, in the particular example 4, the period length of those two no-light emitting periods which are positioned comparatively near to the center is set so as to be shorter than the period length of the other two no-light emitting periods positioned on the outer sides of the centrally positioned no-light emitting periods.

FIGS. 22A to 22D illustrate arrangement of the light emitting periods in this instance and a variation of the period lengths by variation of the total light emitting period.

In the example of FIGS. 22A to 22D, the no-light emitting period between the first and second light emitting periods is referred to as first no-light emitting period.

Further, the no-light emitting period between the second and third light emitting periods is referred to as second no-light emitting period; the no-light emitting period between the third and fourth light emitting periods is referred to as third no-light emitting period; and the no-light emitting period between the fourth and second fifth emitting periods is referred to as fourth no-light emitting period.

In FIGS. 22A to 22D, the period length of the first and fourth no-light emitting periods is represented by a and the time period length of the second and third no-light emitting periods is represented by b.

Here, if the rate of the period length b is lower than the rate of the period length a, then the three light emitting periods positioned centrally can be positioned nearer to each other and the unity of the three light emitting periods can be enhanced. As a result, an effect of suppressing appearance of motion blur where the total light emitting period length is short can be achieved.

It is to be noted that the ratio between the period lengths a and b may be set to an arbitrary value. It is to be noted, however, that the ratio a:b is given by the ratio of the period length of the light emitting period at the central position and the period length of the light emitting periods positioned on the opposite outer sides of the centrally positioned light emitting period. In other words, the ratio a:b is set such that the relationship in rate may be reverse to each other between the light emitting periods and the no-light emitting periods.

Accordingly, in the example of FIGS. 22A to 22D, the ratio a:b is set to 2:1 (=3:1.5) which is a ratio between the period length of the third light emitting period and the period length of the second light emitting period.

As a result, if the total light emitting period length is given by A % of a one-field period, then the period lengths of the light emitting period and the no-light emitting periods are given by expressions given below.

It is to be noted that, in the following description, the period length of the first and fifth light emitting periods is represented by T1 and the period length of the second and fourth light emitting periods is represented by T2 while the period length of the third light emitting period is represented by T3. Further, the period length of the first and fourth no-light emitting periods is represented by T4, and the period length of the second and third no-light emitting periods is represented by T5.

$$T1=A\ \%/8$$

$$T2=(A\ \%/8)*1.5$$

$$T3=(A\ \%/8)*3$$

$$T4=\{(75\%-A\ \%)/6\}*2$$

$$T5=(75\%-A\ \%)/6$$

For example, if the total light emitting period length is 40% of a one-field period, then the period lengths are calculated in the following manner:

$$T1=40\%/8=5\%$$

$$T2=(40\%/8)*1.5=7.5\%$$

$$T3=(40\%/8)*3=15\%$$

$$T4=(75\%-40\%)/3=11.6\%$$

$$T5=(75\%-40\%)/6=5.8$$

As a result, where the start timing and the end timing of each light emitting period are represented by (X %, Y %), the arrangement positions of the light emitting periods are set in the following manner:

First light emitting period: (0%, 5%)

Second light emitting period: (16.6%, 24.1%)

Third light emitting period: (30%, 45%)

Fourth light emitting period: (50.8%, 58.3%)

Fifth light emitting period: (70%, 75%)

In this manner, in the case of the particular example 4, the distance between adjacent ones of the second to fourth light emitting periods can be reduced so that the light emitting periods approach each other. As a result, the third light emitting period and the second and fourth light emitting periods positioned on the opposite sides of the third light emitting period are perceived principally, and besides, the unity of them can be enhanced. As a result, motion blur is less likely to appear, and the visibility of a moving picture image can be enhanced further.

It is to be noted that, as described hereinabove, where the total light emitting period length is 75% of a one-field period, the only one light emitting period is set as (0%, 75%).

Further, also in the case of the particular example 4, 75% of a one-field period are set as an apparent appearance range of a light emitting period. Therefore, basically flickering is not perceived.

As a result, a light emitting period which provides reduced flickering to assure enhanced picture quality of a moving picture image can be set.

e. Particular Example 5 (N=5)

Also here, a setting example wherein the light emitting period number N is 5 is described. Also in the present particular example, the period length of the light emitting periods is set to a ratio of 1:2:6:2:1 in the appearing order of them. Also the present particular example 5 adopts the system wherein the period length of those two no-light emitting periods which are positioned comparatively near to the center is set so as to be shorter than the period length of the other two no-light emitting periods positioned on the outer sides of the centrally positioned no-light emitting periods.

FIGS. 23A to 23D illustrate arrangement of the light emitting periods in this instance and a variation of the period lengths by variation of the total light emitting period.

Also in the example of FIGS. 23A to 23D, the no-light emitting period between the first and second light emitting periods is referred to as first no-light emitting period.

Further, the no-light emitting period between the second and third light emitting periods is referred to as second no-light emitting period; the no-light emitting period between the third and fourth light emitting periods is referred to as third no-light emitting period; and the no-light emitting period between the fourth and fifth emitting periods is referred to as fourth no-light emitting period.

In FIGS. 23A to 23D, the period length of the first and fourth no-light emitting periods is represented by a and the time period length of the second and third no-light emitting periods is represented by b.

In the present particular example, the period length of the non-light emitting periods is set by the same method as in the particular example 4. In particular, the ratio of a:b is given by the ratio between the period length of the third no-light emitting period positioned centrally and the period length of the second or fourth light emitting period positioned on the outer side of the third light emitting period.

Accordingly, in the example of FIGS. 23A to 23D, the ratio a:b is set to 3:1.

As a result, if the total light emitting period length is given by A % of a one-field period, then the period lengths of the light emitting period and the no-light emitting periods are given by expressions given below.

It is to be noted that, in the following description, the period length of the first and fifth light emitting periods is represented by T1 and the period length of the second and fourth light emitting periods is represented by T2 while the period length of the fifth light emitting period is represented by T3. Further, the period length of the first and fourth no-light emitting periods is represented by T4, and the period length of the second and third no-light emitting periods is represented by T5.

$$T1=A\ \%/12$$

$$T2=(A\ \%/12)*2$$

$$T3=(A\ \%/12)*6$$

$$T4=\{(75\%-A\ \%)/8\}*3$$

$$T5=(75\%-A\ \%)/8$$

For example, if the total light emitting period length is 40% of a one-field period, then the period lengths are calculated in the following manner:

$$T1=40\%/12=3.3\%$$

$$T2=(40\%/12)*2=6.6\%$$

$$T3=(40\%/12)*6=20\%$$

$$T4=(75\%-40\%/8)*=13.1\%$$

$$T5=(75\%-40\%)/8=4.37\%$$

As a result, where the start timing and the end timing of each light emitting period are represented by (X %, Y %), the arrangement positions of the light emitting periods are set in the following manner:

First light emitting period: (0%, 3.3%)

Second light emitting period: (16.4%, 23%)

Third light emitting period: (27.3%, 47.3%)

Fourth light emitting period: (51.7%, 58.3%)

Fifth light emitting period: (71.7%, 75%)

In the case of the particular example 5, the distance between adjacent ones of the second to fourth light emitting periods can be reduced so that the light emitting periods approach each other. As a result, the third light emitting period and the second and fourth light emitting periods positioned on the opposite sides of the third light emitting period are perceived principally, and besides, the unity of them can be enhanced. As a result, motion blur is less likely to appear, and the visibility of a moving picture image can be enhanced further.

It is to be noted that, as described hereinabove, where the total light emitting period length is 75% of a one-field period, the only one light emitting period is set as (0%, 75%).

Further, also in the case of the particular example 5, 75% of a one-field period are set as an apparent appearance range of a light emitting period. Therefore, basically flickering is not perceived.

As a result, a light emitting period which provides reduced flickering to assure enhanced picture quality of a moving picture image can be set.

f. Particular Example 6 (others)

The setting method described above can be applied similarly also where the light emitting period number N is any odd number equal to or higher than 7.

In particular, a comparatively high rate is allocated to the period length of a light emitting period from among the N light emitting periods which is comparatively near to the center of the N light emitting periods and the individual period lengths are varied in response to variation of the total light emitting period length while the rates are maintained.

In this instance, the technique of the particular examples described above can be applied also to allocation of the no-light emitting periods.

For example, also it is possible to apply a method wherein all period lengths are set equal to each other or another method wherein a comparatively low rate is applied to a no-light emitting period which is positioned comparatively near to the center.

For reference, examples where the light emitting period number N is 7 are illustrated in FIGS. 24A to 24C and 25A to 25C.

Figures 24A, 24B, 24C:
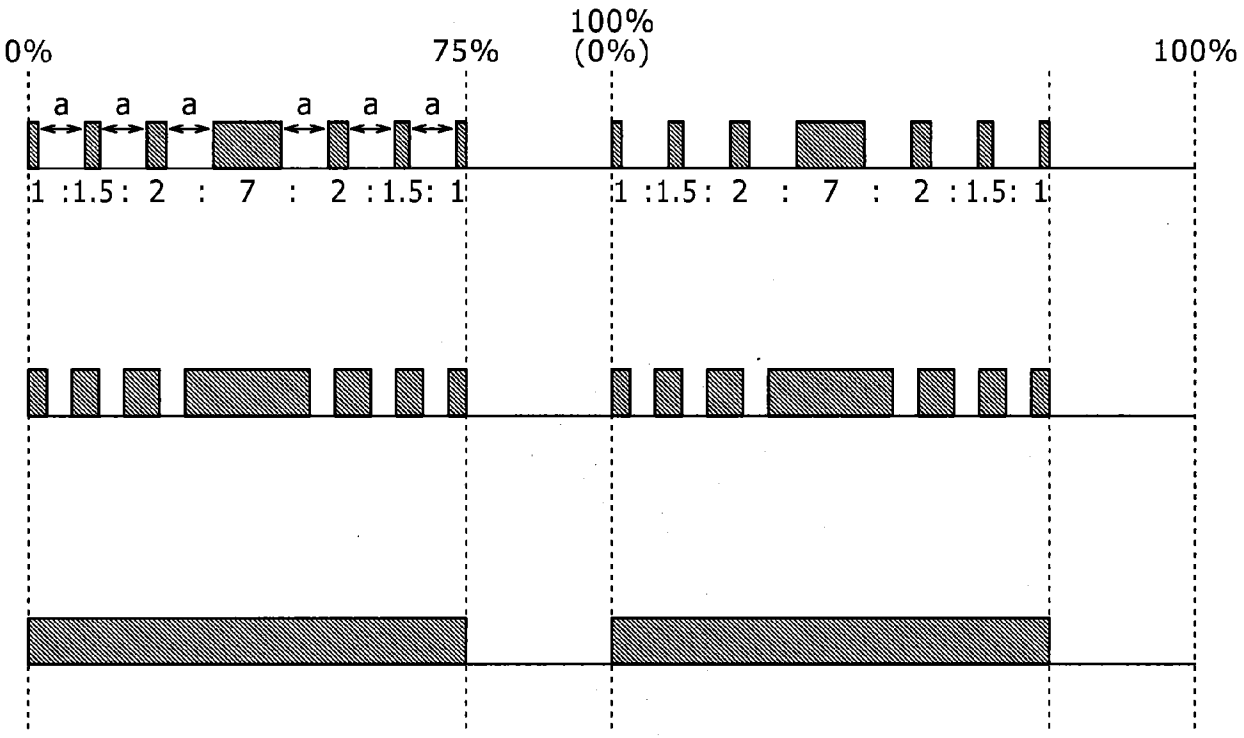

FIGS. 24A to 24C illustrate an example where the period length of the light emitting periods is set to a ratio of 1:1.5:2:7:2:1.5:1 in the appearing order of them. It is to be noted that FIGS. 24A to 24C correspond to a case wherein the period lengths of all of the no-light emitting periods are set to an equal value.

Figures 25A, 25B, 25C:
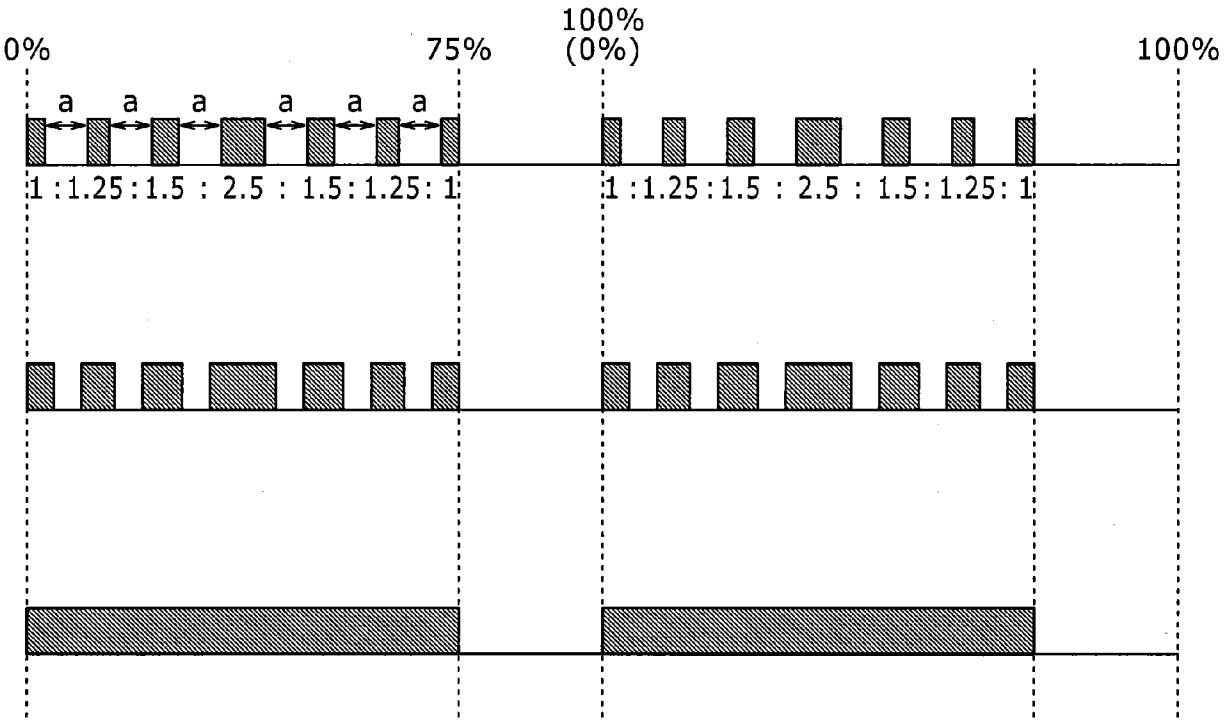

Meanwhile, FIGS. 25A to 25C illustrate another example where the period length of the light emitting periods is set to a ratio of 1:1.25:1.5:2.5:1.5:1.25:1 in the appearing order of them. It is to be noted that also FIGS. 25A to 25C correspond to a case wherein the period lengths of all of the no-light emitting periods are set to an equal value.

B-4. Example of Setting where Light Emitting Period Number N is Even Number

Now, setting examples where the light emitting period number N is an even number equal to or higher than 4 are described. It is to be noted that a basic approach in this instance is similar to that where the light emitting period number N is an odd number.

a. Particular Example 1 (N=4)

Here, a setting example wherein the light emitting period number N is 4 is described. It is assumed that the period length of the light emitting periods in the present particular example is set to a ratio of 1:2:2:1 in the appearing order of them.

FIGS. 26A to 26D illustrate arrangement of the light emitting periods and variation of period lengths caused by variation of the total light emitting period length.

It is to be noted that FIGS. 26A to 26D illustrate the arrangement and the variation described above in a case wherein the maximum value of the total light emitting period length is set to 60% of a one-field period.

Therefore, the light emitting periods are varied within a range from 0% to 60% of a one-field period. Further, the range from 60% to 100% of each one-field period is normally set to a no-light emitting period. The presence of such a fixed non-light emitting period as just described is essentially required in order to raise the visibility of a moving picture.

As a result, the start timing of the first light emitting period is fixed to 0%, and the end timing of the fourth light emitting period is fixed to 60%. Further, a method is adopted wherein the period length of the no-light emitting period positioned at the center is set so as to be normally shorter than the period length of the no-light emitting periods positioned on the opposite sides of the centrally positioned no-light emitting period. In particular, the period length b of the no-light emitting period positioned at the second position is set so as to be shorter than the period length a of the no-light emitting periods positioned at the first and third positions.

It is to be noted that the ratio between the period lengths a and b may be set to an arbitrary value. However, as the period length b decreases, the two light emitting periods positioned around the center become more likely to be visually confirmed as a unitary light emitting period and motion blur becomes less likely to be visually confirmed.

In the case of the present particular example, the ratio of the period lengths a and b is set to a ratio reciprocal to the ratio of the light emitting periods. In particular, the ratio a:b is set to 2:1.

Also in the case of the present particular example, as the total light emitting period length increases, the period lengths of the light emitting periods vary so as to be leftwardly and rightwardly symmetrical with respect to the point of 30% within the one-field period which is the center of the variation range.

Figures 26A, 26B, 26C, 26D:
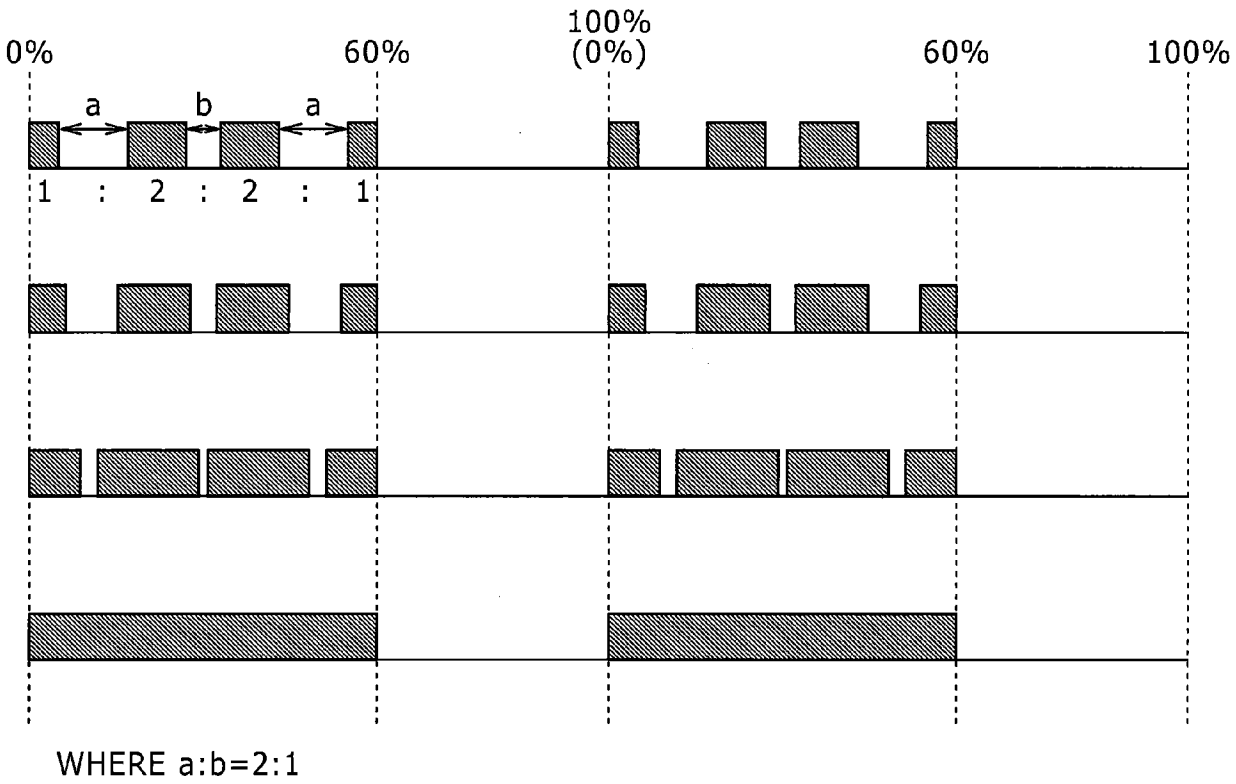
FIGS. 26A to 26D, 27A to 27D and 28A to 28D are timing charts illustrating different examples of driving timings of the organic EL panel of FIG. 16 where the number of light emitting periods is an even number.

Naturally, the period lengths of the light emitting periods vary in a state wherein the ratio of 1:2:2:1 is kept satisfied. Then, if the total light emitting period length reaches its maximum value, then all of the light emitting periods become a unified single light emitting period as seen in FIG. 26D.

At this time, if it is assumed that the total light emitting period is given by A % of a one-field period, then the light emitting periods and the no-light emitting periods are given by the expressions give below.

In the following description, the period length of the first and fourth light emitting periods is represented by T1 and the period length of the second and third light emitting periods is represented by T2. Further, the period length of the first and third no-light emitting periods is represented by T3, and the period length of the second no-light emitting period is represented by T4.

$$T1=A\ \%/6$$

$$T2=A\ \%/3$$

$$T3=\{(60\%-A\ \%)/5\}*2$$

$$T4=\{(60\%-A\ \%)/5\}$$

For example, if the total light emitting period length is 40% of a one-field period, then the period lengths are calculated in the following manner:

$$T1=40\%/6=6.66\%$$

$$T2=40\%/3=13.3\%$$

$$T3=\{(60\%-40\%)/5\}*2=8\%$$

$$T4=(60\%-40\%)/5=4\%$$

As a result, where the start timing and the end timing of each light emitting period are represented by (X %, Y %), the arrangement positions of the light emitting periods are set in the following manner:

First light emitting period: (0%, 6.66%)

Second light emitting period: (14.66%, 28%)

Third light emitting period: (32%, 45.3%)

Fourth light emitting period: (53.3%, 60%)

It is to be noted that, as described hereinabove, where the total light emitting period length is 60% of a one-field period, the only one light emitting period is set as (0%, 60%).

Further, in the case of the particular example 1, 60% of a one-field period are set as an apparent appearance range of a light emitting period. Therefore, basically flickering is not perceived.

As described above, also where the light emitting period number is an even number, it is possible to make two light emitting periods, which are positioned in the proximity of the center, be visually confirmed as a unitary light emitting period. As a result, it is possible to set light emitting periods with which flickering is less likely to be conspicuous and a moving picture image of high display quality can be displayed.

b. Particular Example 2 (N=4)

Now, a setting example wherein the light emitting period number N is 4 is described. It is to be noted that, also in the present particular example, the period length of the four light emitting periods satisfies the ratio of 1:2:2:1.

The particular example 2 is different from the particular example 1 in that the ratio of the period lengths of the no-light emitting periods is set so that the second and third light emitting periods approach each other.

In particular, the ratio a:b is set to 4:1.

FIGS. 27A to 27D illustrate arrangement of the light emitting periods in this instance and a variation of the period lengths by variation of the total light emitting period.

It is to be noted that also FIGS. 27A to 27D illustrate the arrangement and the variation described above in a case wherein the maximum value of the total light emitting period length is set to 60% of a one-field period.

Therefore, the light emitting periods are varied within the range of 0% to 60% of a one-field period. Further, the range from 60% to 100% of each one-field period is normally set to a no-light emitting period. The presence of such a fixed non-light emitting period as just described is essentially required in order to raise the visibility of a moving picture.

As a result, the start timing of the first light emitting period is fixed to 0%, and the end timing of the fourth light emitting period is fixed to 60%.

Also in the case of the present particular example, as the total light emitting period length increases, the period lengths of the light emitting periods vary so as to be leftwardly and rightwardly symmetrical with respect to the point of 30% within the one-field period which is the center of the variation range.

Figures 27A, 27B, 27C, 27D:
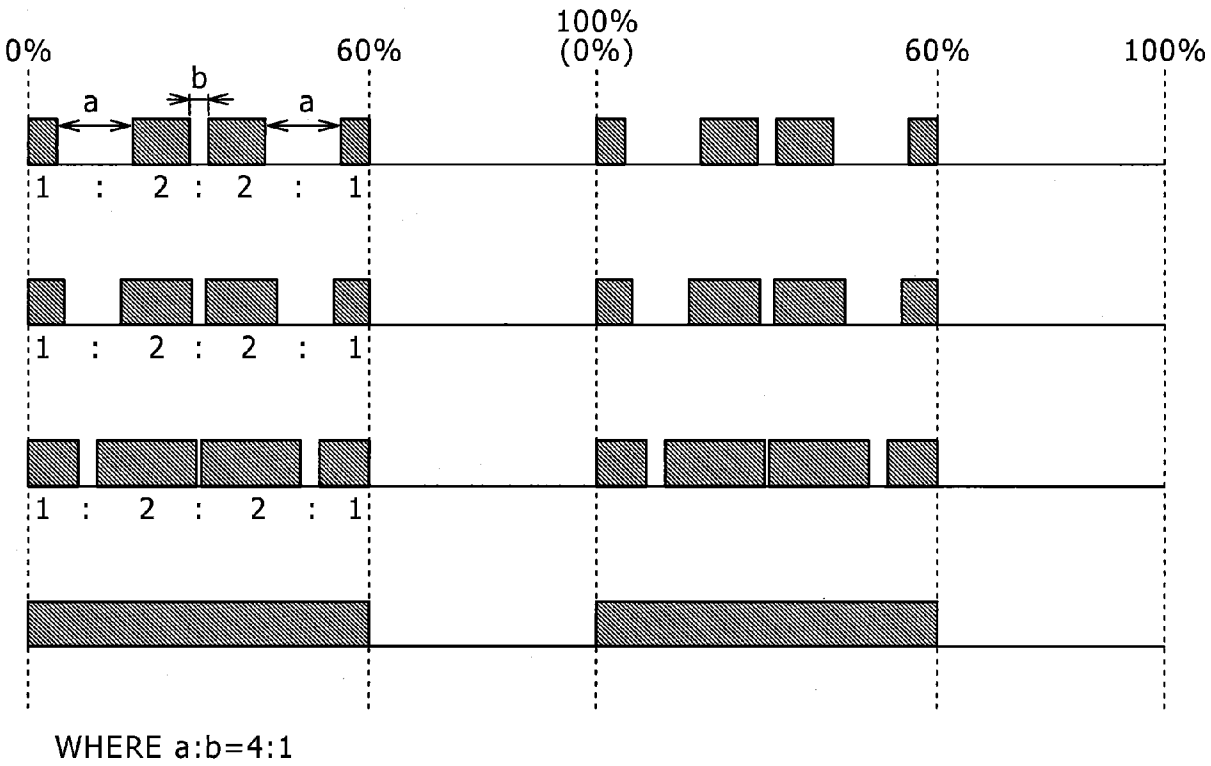

Naturally, the period lengths of the light emitting periods vary in a state wherein the ratio of 1:2:2:1 is kept satisfied. Then, if the total light emitting period length reaches its maximum value, then all of the light emitting periods become a unified single light emitting period as seen in FIG. 27D.

At this time, if it is assumed that the total light emitting period is given by A % of a one-field period, then the light emitting periods and the no-light emitting periods are given by the expressions give below.

In the following description, the period length of the first and fourth light emitting periods is represented by T1 and the period length of the second and third light emitting periods is represented by T2. Further, the period length of the first and third no-light emitting periods is represented by T3, and the period length of the second no-light emitting period is represented by T4.

$$T1=A\ \%/6$$

$$T2=A\ \%/3$$

$$T3=\{(60\%-A\ \%)/9\}*4$$

$$T4=(60\%-A\ \%)/9$$

For example, if the total light emitting period length is 40% of a one-field period, then the period lengths are calculated in the following manner:

$$T1=40\%/6=6.66\%$$

$$T2=40\%/3=13.3\%$$

$$T3=\{(60\%-40\%)/9\}*4=8.88\%$$

$$T4=(60\%-40\%)/9=2.2\%$$

As a result, where the start timing and the end timing of each light emitting period are represented by (X %, Y %), the arrangement positions of the light emitting periods are set in the following manner:

First light emitting period: (0%, 6.66%)

Second light emitting period: (15.5%, 28.8%)

Third light emitting period: (31%, 44.3%)

Fourth light emitting period: (53.3%, 60%)

It is to be noted that, as described hereinabove, where the total light emitting period length is 60% of a one-field period, the only one light emitting period is set as (0%, 60%).

Further, in the case of the particular example 2, 60% of a one-field period are set as an apparent appearance range of a light emitting period. Therefore, basically flickering is not perceived.

It is to be noted that, with the present particular example 2, the unity of the two light emitting periods positioned at the center can be further enhanced from that in the particular example 1. As a result, it is possible to set light emitting periods with which flickering is less likely to be conspicuous and a moving picture image of high display quality can be displayed.

c. Particular Example 3 (N=4)

Now, a setting example wherein the light emitting period number N is 4 is described. It is to be noted that, also in the present particular example, the period length of the light emitting periods is set so as to satisfy the ratio of 1:2:2:1.

The particular example 3 is different from the particular examples 1 and 2 in that the period length of the second no-light emitting period is fixed until the total light emitting period length reaches a preset value. In other words, in the particular example 3, only the first and third no-light emitting periods are varied until the total light emitting period length reach the preset value.

It is to be noted that the period length of the second no-light emitting periods is preferably set to a value as low as possible because the second and third light emitting periods approach each other.

Further, the period lengths of the first and third no-light emitting periods are set so as to be equal to each other.

FIGS. 28A to 28D illustrate arrangement of the light emitting periods in the present particular example and a variation of the period lengths by variation of the total light emitting period.

Also in the example of FIGS. 28A to 28D, the maximum value of the total light emitting period length is set to 60% of a one-field period. Therefore, the light emitting periods are varied within a range from 0% to 60% of a one-field period. Further, the range from 60% to 100% of each one-field period is normally set to a no-light emitting period. The presence of such a fixed non-light emitting period as just described is essentially required in order to raise the visibility of a moving picture.

As a result, the start timing of the first light emitting period is fixed to 0%, and the end timing of the fourth light emitting period is fixed to 60%.

Also in the case of the present particular example, as the total light emitting period length increases, the period lengths of the light emitting periods vary so as to be leftwardly and rightwardly symmetrical with respect to the point of 30% within the one-field period which is the center of the variation range.

Figures 28A, 28B, 28C, 28D:
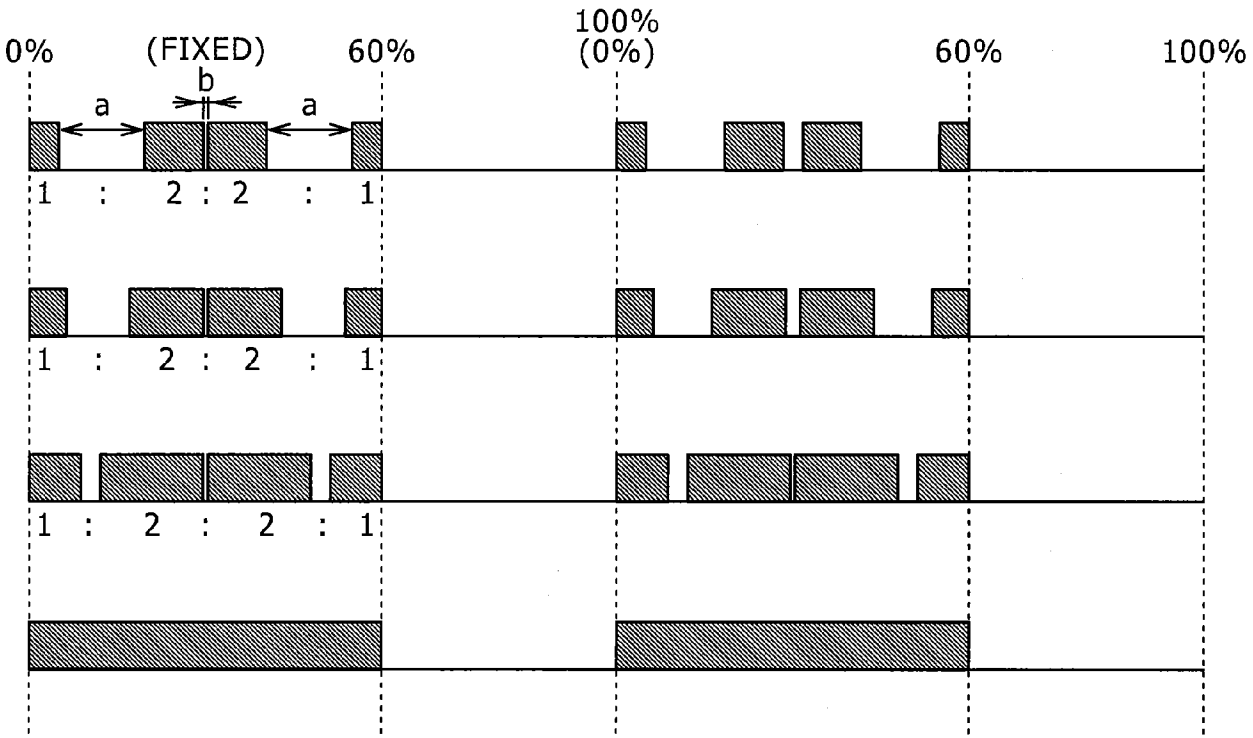
Figures 29A, 29B, 29C, 29D:
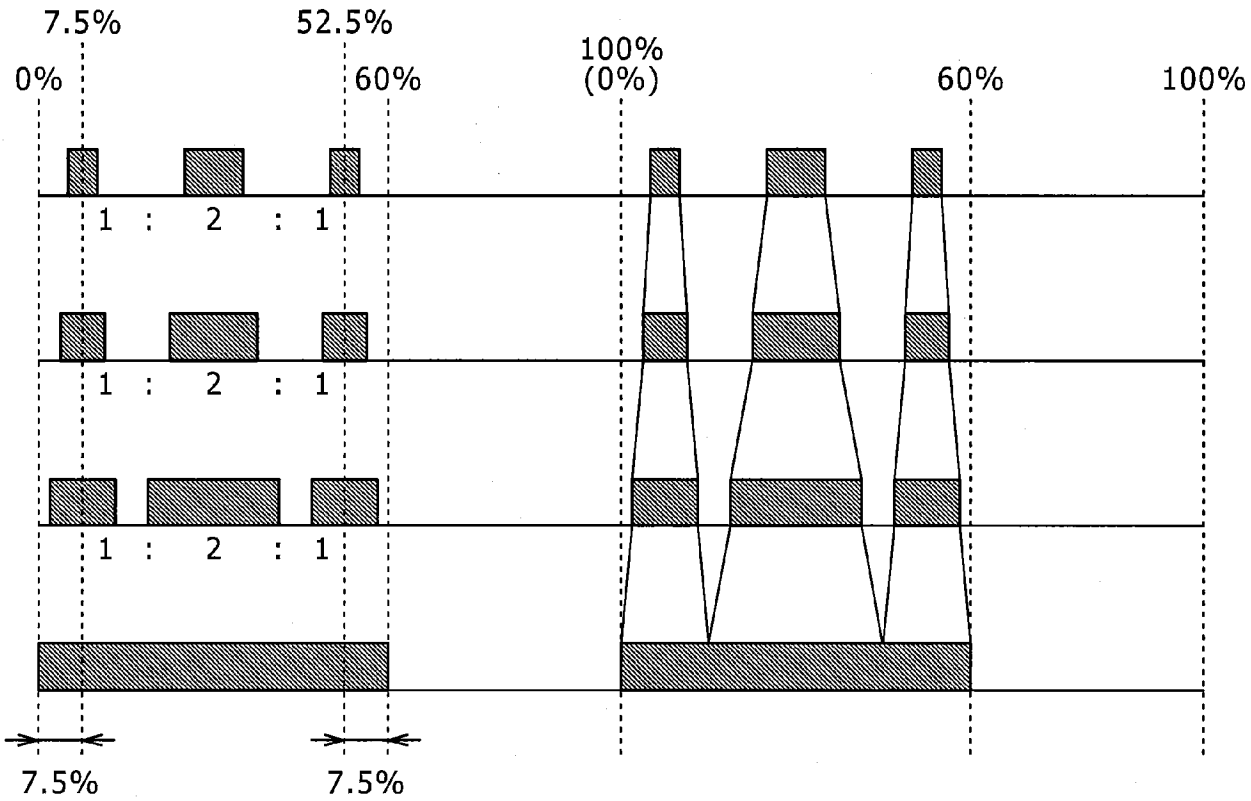
FIGS. 29A to 29D, 30A to 30D and 31A to 31D are timing charts illustrating different examples of driving timings of the organic EL panel of FIG. 16.
Figures 30A, 30B, 30C, 30D:
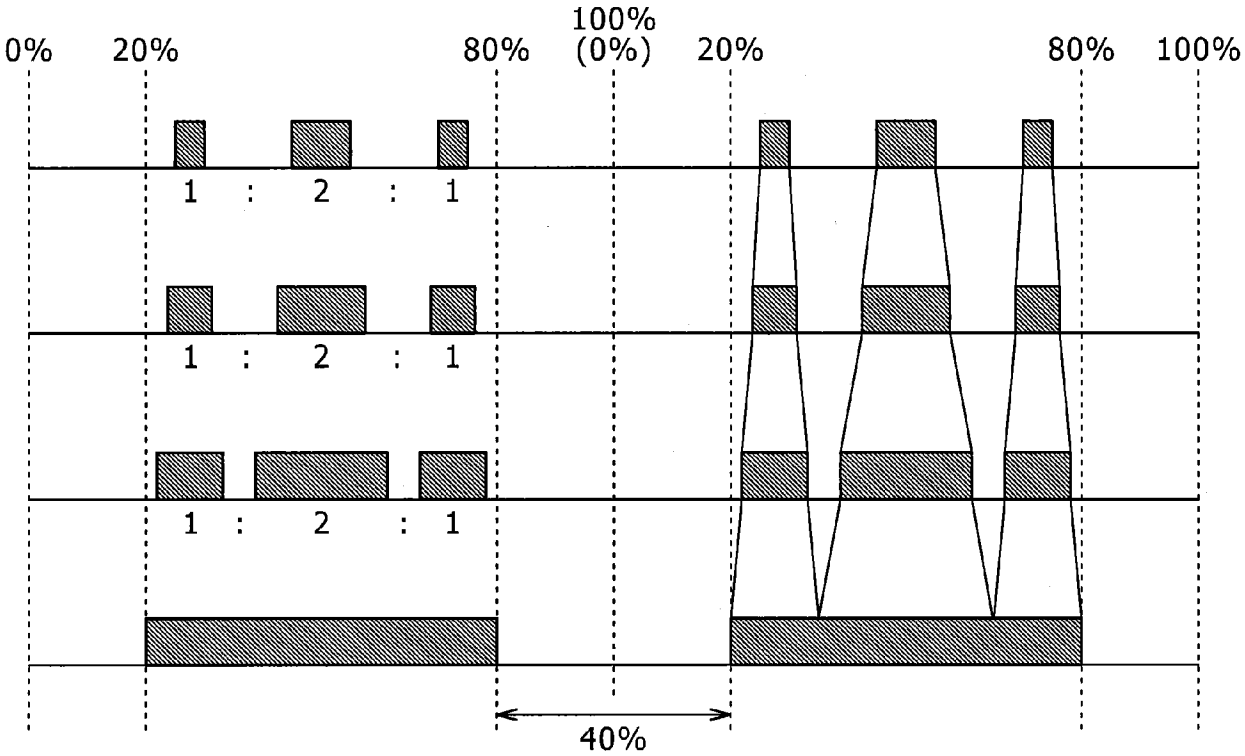
Figures 31A, 31B, 31C, 31D:
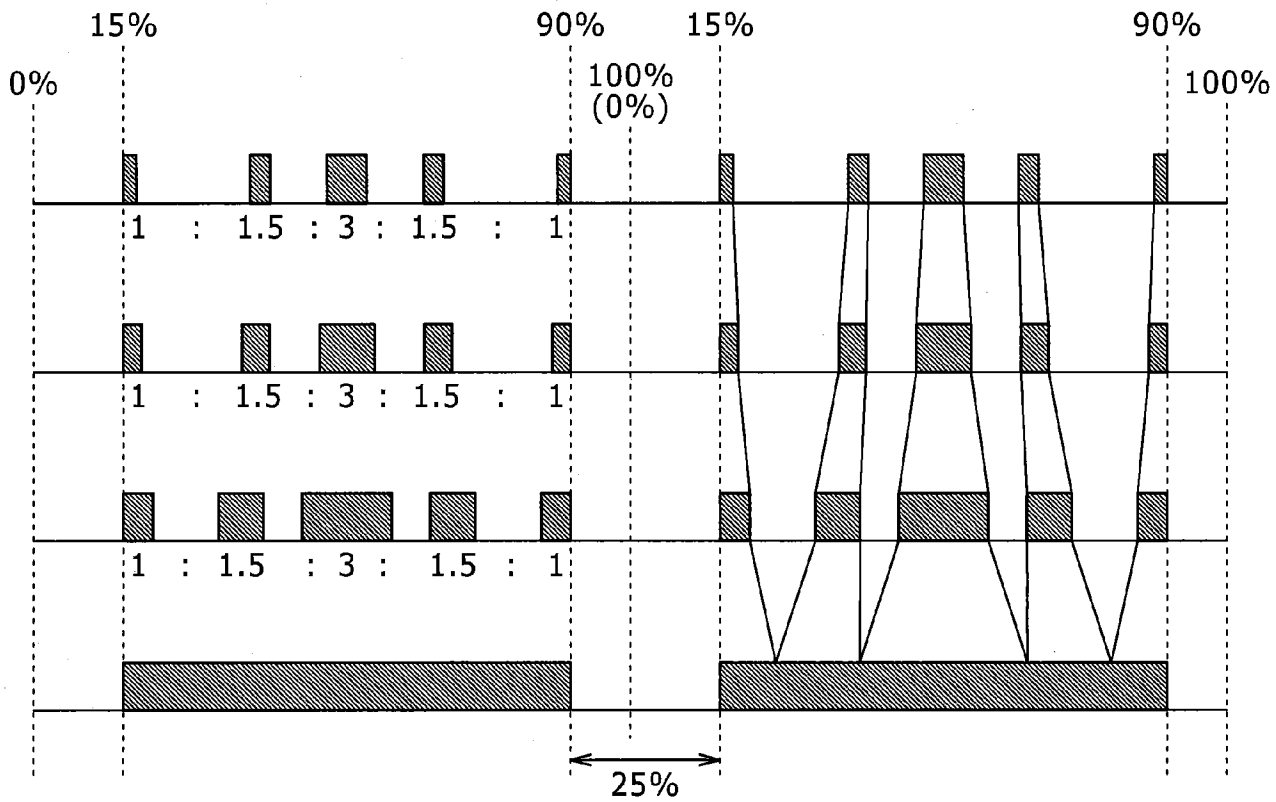

Naturally, the period lengths of the light emitting periods vary in a state wherein the ratio of 1:2:2:1 is kept satisfied. Then, if the total light emitting period length reaches its maximum value, then all of the light emitting periods become a unified single light emitting period as seen in FIG. 28D.

At this time, if it is assumed that the total light emitting period is given by A % of a one-field period, then when the period length of the second no-light emitting period is fixed to b %, the light emitting periods and the no-light emitting periods are given by the expressions give below.

In the following description, the period length of the first and fourth light emitting periods is represented by T1 and the period length of the second and third light emitting periods is represented by T2. Further, the period length of the first and third no-light emitting periods is represented by T3.

Where the total light emitting period length is equal to or greater than 0% but equal to or lower than 60−b %, the three emitting periods are given by the following expressions:

$$T1=A\ \%/6$$

$$T2=A\ \%/3$$

$$T3=(60\%-A\ \%-b\ \%)/2$$

For example, if the total light emitting period length is 40% of a one-field period and the period length of the second no-light emitting period is 1%, then the period lengths where the total light emitting period length is equal to or higher than 0% but equal to or lower than 59% are given by the following expressions:

$$T1=40\%/6=6.66\%$$

$$T2=40\%/3=13.3\%$$

$$T3=(60\%-40\%-1\%)/2=9.5\%$$

As a result, where the start timing and the end timing of each light emitting period are represented by (X %, Y %), and the period lengths where the total light emitting period length is equal to or higher than 0% but equal to or lower than 59%, the arrangement positions of the light emitting periods are set in the following manner:

First light emitting period: (0%, 6.66%)

Second light emitting period: (16.1%, 29.5%)

Third light emitting period: (30.5%, 43.7%)

Fourth light emitting period: (53.3%, 60%)

It is to be noted that, where the total light emitting period length is greater than 60−b %, the number of light emitting periods becomes two. Also here, where the period length of the first and second light emitting periods is represented by T1 and the period length of the no-light emitting period between them is represented by T2, the period lengths are given by the following expressions:

$$T1=A\ \%/2$$

$$T2=60\%-A\ \%$$

For example, if the total light emitting period length is 59.6% of a one-field period, then the period lengths are given by the following expressions:

$$T1=59.6\%/2=29.8\%$$

$$T2=60\%-59.6\%=0.4\%$$

As a result, where the start timing and the end timing of each light emitting period are represented by (X %, Y %), the arrangement positions of the light emitting periods where the total light emitting period length is 59.6% of a one-field period are set in the following manner:

First light emitting period: (0%, 29.8%)

Second light emitting period: (30.2%, 60%)

Naturally, where the total light emitting period length is 60% of a one-field period, the only one light emitting period is set as (0%, 60%).

Further, in the case of the particular example 3, 60% of a one-field period are set as an apparent appearance range of a light emitting period. Therefore, basically flickering is not perceived.

It is to be noted that, according to the present setting method, as the period length of those light emitting periods to be set at a central portion of the variation range decreases, the arrangement of the light emitting periods approaches the arrangement of the light emitting periods where the light emitting period number N is an odd number.

As a result of the foregoing, it is possible to set light emitting periods with which flickering is less likely to occur and a moving picture image of high display quality can be displayed.

d. Particular Example 4 (others)

The setting method described above can be applied similarly also where the light emitting period number N is any odd number equal to or higher than 6.

In particular, a comparatively high rate is allocated to the period length of a light emitting period from among the N light emitting periods which is comparatively near to the center of the N light emitting periods and the individual period lengths are varied in response to variation of the total light emitting period length while the rates are maintained.

In this instance, the technique of the particular examples described above can be applied also to allocation of the no-light emitting periods.

For example, it is possible to apply the method wherein all period lengths are set equal to each other or the method wherein a comparatively low rate is applied to a no-light emitting period which is positioned comparatively near to the center. In addition, a method is adopted wherein the period length of the no-light emitting period positioned at the center can be basically fixed For example, the period length of the light emitting periods may be set to a ratio of 1:1.5:3:3:1.5:1 in the appearing order of them. Or, for example, where the light emitting period number N is 8, the period length of the light emitting periods is set to a ratio of 1:1.25:1.5:2.5:2.5:1.5:1.25:1 in the appearing order of them.

C. Other Embodiments

C-1. Variation Method 1 of Light Emitting Periods

In the embodiment described above, the start timing of the first light emitting period and the end timing of the Nth light emitting period are fixed.

In other words, in the embodiment described above, the start timing of the first light emitting period is set to 0% of a one-field period and the end timing of the Nth light emitting period is set to a maximum value of the total light emitting period length.

However, another setting method may be applied alternatively wherein also the start timing of the first light emitting period and the end timing of the Nth light emitting period are varied similarly to the other light emitting periods.

FIGS. 29A to 29D illustrate an example of setting of light emitting periods where the light emitting period number N is 3 and particularly the period length of the light emitting periods is set to a ratio of 1:2:1 in the appearing order of them. Further, it is assumed that the maximum value of the total light emitting period length is 60% of a one-field period. In this instance, 15% are applied to each of the first and third light emitting periods while 30% are applied to the second light emitting period.

Accordingly, in FIGS. 29A to 29D, for the first light emitting period, the start timing and the end timing are set with reference to 7.5%; for the second light emitting period, the start timing and the end timing are set with reference to 30%; and for the third light emitting period, the start timing and the end timing area set with reference to 52.5%.

In this instance, the apparent light emitting period is variably controlled in response to the total light emitting period length within the range of 45% to 60%. Accordingly, flickering is not perceived. Further, in this instance, a no-light emitting period of at least 40% is assured, and a continuous no-light emitting period of approximately 55% in the maximum can be assured. Therefore, also the moving picture responsibility can be enhanced.

C-2. Variation Method 2 of Light Emitting Period

In the embodiment described above, the start timing of the first light emitting period is set to 0% of a one-field period and the end timing of the Nth light emitting period is set to a maximum value of the total light emitting period length.

However, the variation range of the light emitting period may be set to any range within a one-field period.

FIGS. 30A to 30D and 31A to 31D illustrate examples wherein the variation range of the light emitting period described hereinabove is offset.

In particular, FIGS. 30A to 30D illustrate a setting example where the light emitting period number N is 3 and FIGS. 31A to 31D illustrate another setting example where the light emitting period number N is 5.

It is to be noted that FIGS. 30A to 30D illustrate a setting example wherein the total light emitting period length is 60% and the light emitting periods are set within a range from 20% to 80% within a one-field period. The example of FIGS. 30A to 30D is an example of offset setting from a setting example corresponding to that of FIGS. 29A to 29D. Also with the setting method illustrated in FIGS. 30A to 30D, a fixed no-light emitting period of 40% is always assured.

Meanwhile, FIGS. 31A to 31D illustrate a setting example wherein the total light emitting period length is 75% and the light emitting periods are set within a range from 15% to 90% within a one-field period. This example is an example of offset setting from a setting example corresponding to that of FIGS. 21A to 21D. Also with the setting method illustrated in FIGS. 31A to 31D, a fixed no-light emitting period of 25% is assured.

C-3. Other Display Device Examples

The setting method of a light emitting period described above can be applied to apparatus other than the organic EL panel. For example, the setting method can be applied also to an inorganic EL panel, a display panel including an array of LEDs, and a display panel of the self-luminous type wherein EL elements having a diode structure are arrayed on a display screen.

Further, the setting method of a light emitting period described above can be applied also to a liquid crystal display panel wherein an EL element is used for a backlight source or a display panel of the non-self-luminous type.

Figure 32:
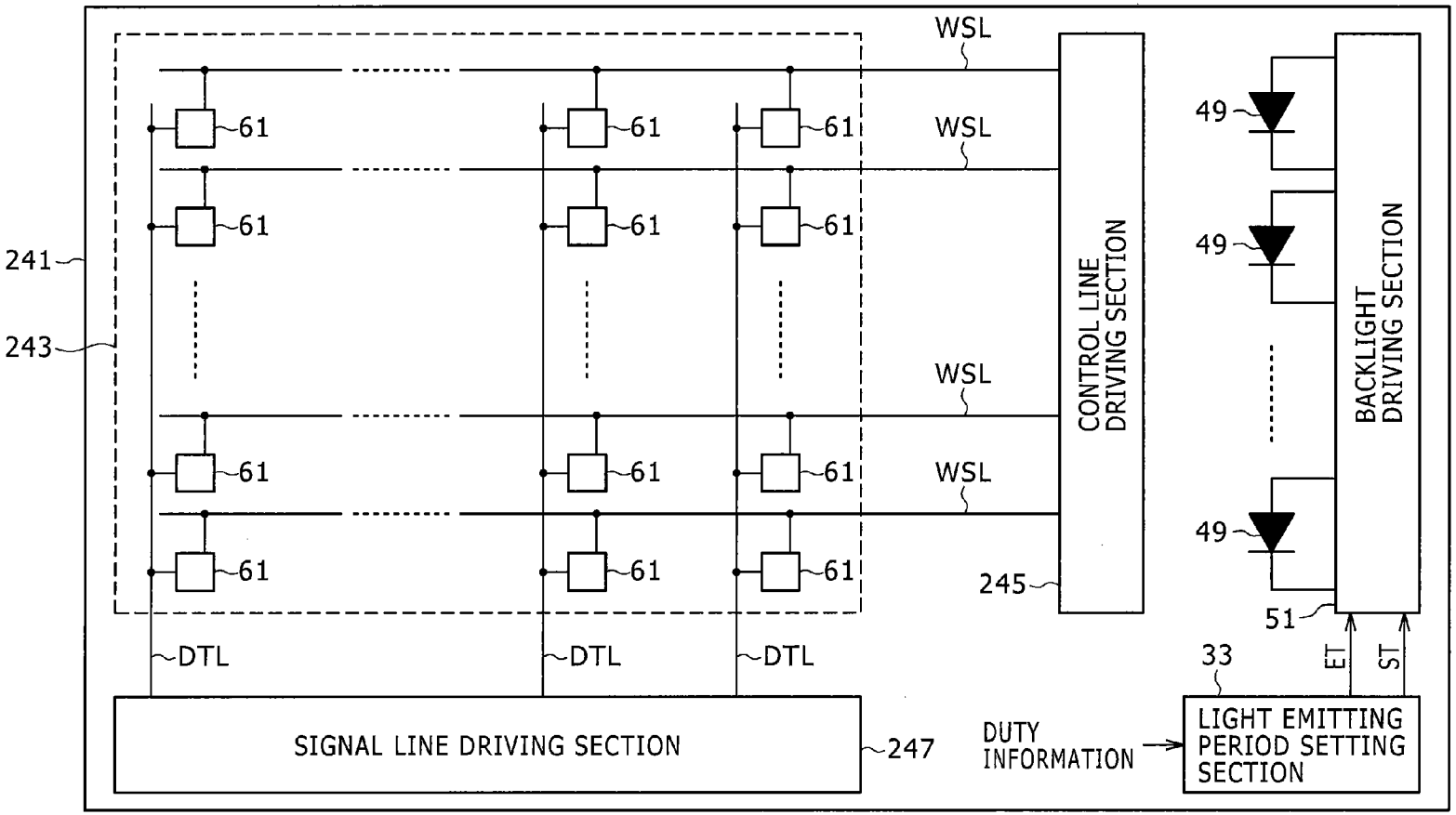
FIG. 32 is a block diagram showing an example of a system configuration of a liquid crystal panel.

FIG. 32 shows an example of a system configuration of the liquid crystal panel 241.

The liquid crystal panel 241 includes a pixel array section 243, a control line driving section 245 configured to drive writing control lines WSL, a signal line driving section 247 configured to drive signal lines DTL, a backlight driving section 51 for driving LEDs 49 for a backlight, and a light emitting period setting section 33 configured to set a light emitting period, arranged on a glass substrate as a support substrate.

The pixel array section 243 has a pixel structure wherein sub pixels 61 are arranged in a matrix, and functions as a liquid crystal shutter. In this instance, each of the sub pixels 61 controls the transmission amount (including interception) of backlight light based on a signal potential Vsig corresponding to gradation information.

Figure 33:
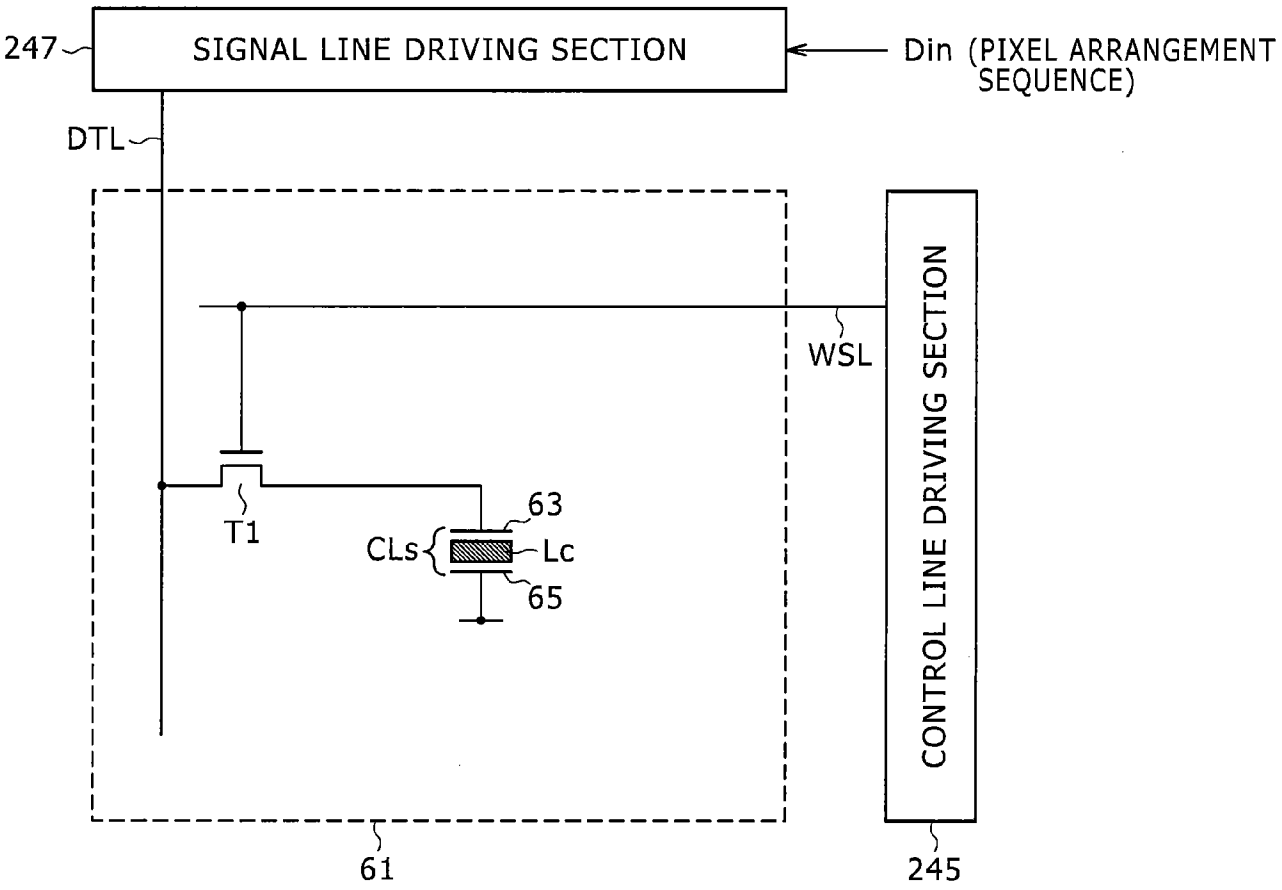
FIG. 33 is a block diagram illustrating a connection relationship between a pixel circuit and a driving section shown in FIG. 32.

FIG. 33 shows a pixel structure of a sub pixel 61. Referring to FIG. 33, the sub pixel 61 shown includes a thin film transistor or sampling transistor T1 and a liquid crystal capacitor CLc for storing the signal potential Vsig. The liquid crystal capacitor CLc has a structure wherein liquid crystal Lc is sandwiched by and between a pixel electrode 63 and an opposing electrode 65.

The control line driving section 245 is a circuit device for driving a writing control line WSL connected to the gate electrode of the sampling transistor T1 with a binary potential. Meanwhile, the signal line driving section 247 is a circuit device for applying a signal potential Vsig to a signal line DTL to which the sampling transistor T1 is connected at one of main electrodes thereof.

Referring back to FIG. 32, the backlight driving section 51 is a circuit device for driving the LEDs 49 based on driving pulses including a start pulse ST and an end pulse ET supplied thereto from the light emitting period setting section 33. The backlight driving section 51 operates so as to supply driving current to the LEDs 49 within a light emitting period and stop the supply of driving current to the LEDs 49 within a no-light emitting period. The backlight driving section 51 here can be implemented, for example, as a switch connected in series to a current supply line.

C-4. Product Examples (Electronic Apparatus)

The foregoing description is given taking an organic EL panel which incorporates the setting function of a light emitting period according to the embodiment described hereinabove as an example. However, an organic EL panel and other display panels which incorporate the setting function described above are distributed also in the form of products in which they are incorporated in various electronic apparatus. In the following, examples of an electronic apparatus in which the organic EL panel or the like is incorporated are described.

Figure 34:
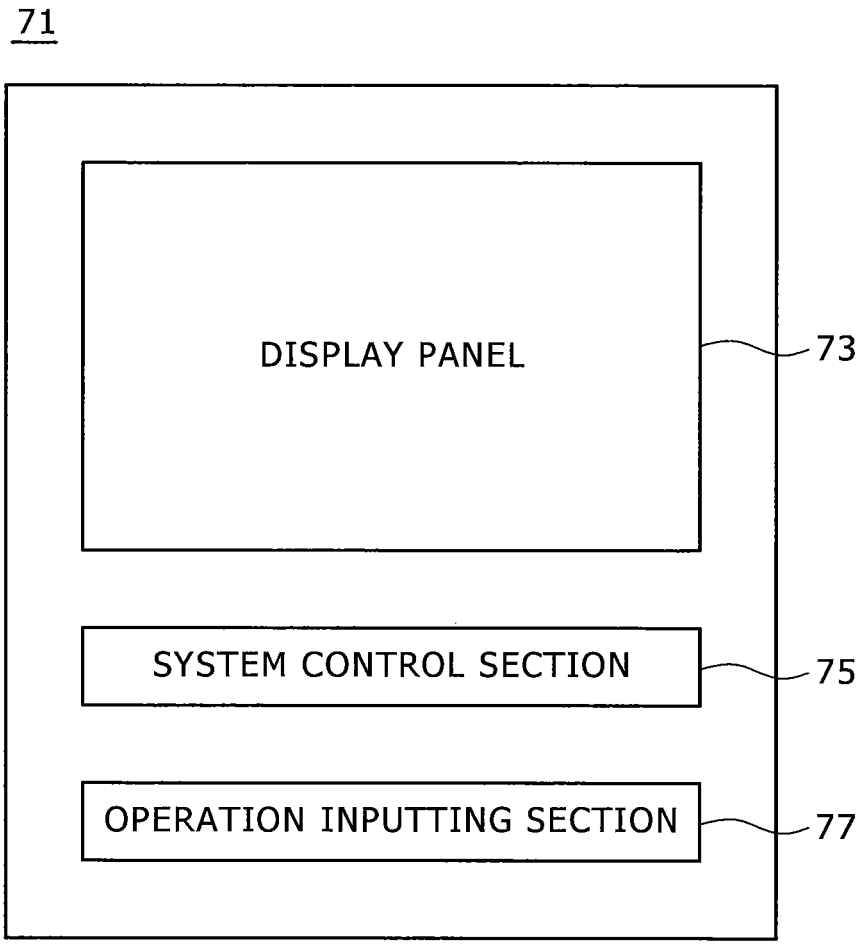
FIG. 34 is a schematic view showing an example of a functional configuration of an electronic apparatus.

FIG. 34 shows an example of a configuration of an electronic apparatus 71. Referring to FIG. 34, the electronic apparatus 71 includes a display panel 73 which incorporates the light emitting period setting function described hereinabove, a system control section 75 and an operation inputting section 77. The contents of processing executed by the system control section 75 differ depending upon the form of a commodity of the electronic apparatus 71. The operation inputting section 77 is a device for accepting an operation input to the system control section 75. The operation inputting section 77 may include, for example, switches, buttons or some other mechanical interface, a graphic interface or the like.

It is to be noted that the electronic apparatus 71 is not limited to an apparatus in a particular field only if it incorporates a function of displaying an image produced in the apparatus or inputted from the outside.

Figure 35:
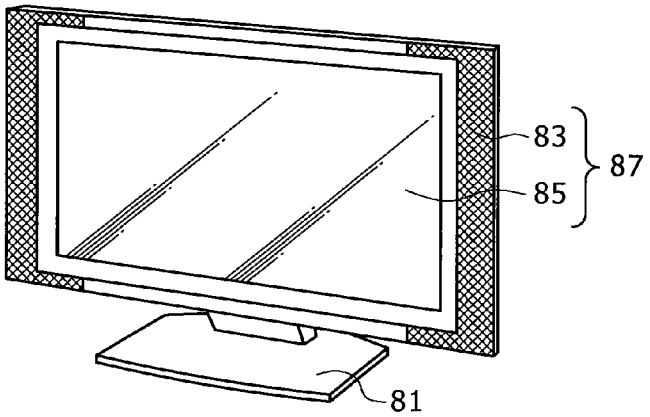
FIGS. 35, 36A and 36B, 37, 38A and 38B, and 39 are schematic views showing different examples of the electronic apparatus of FIG. 34 as a commodity.

FIG. 35 shows an appearance of an electronic apparatus in the form a television receiver. Referring to FIG. 35, the television receiver 81 includes a display screen 87 provided on the front face of a housing thereof and including a front panel 83, a filter glass plate 85 and so forth. The display screen 87 corresponds to the display panel 73.

Figure 36A:
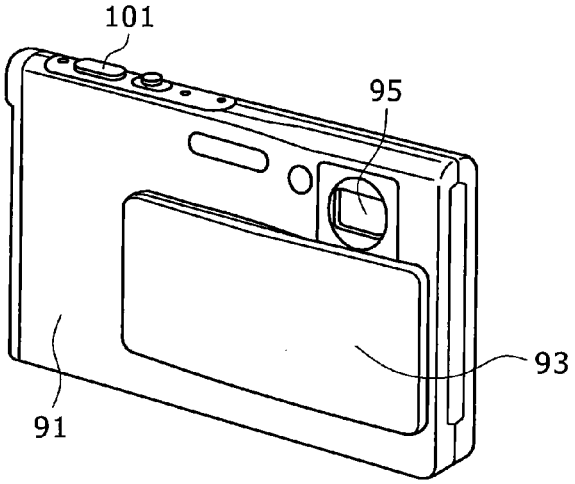
Figure 36B:
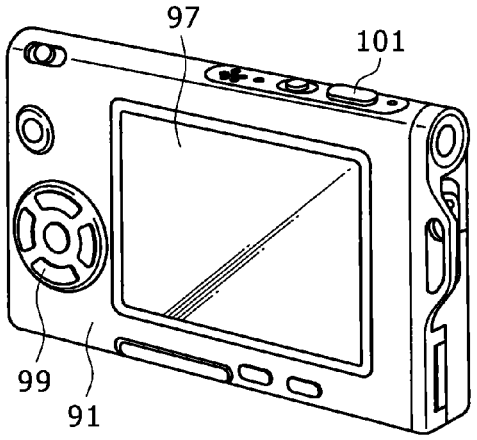

The electronic apparatus 71 may alternatively have a form of, for example, a digital camera. FIGS. 36A and 36B show an example of an appearance of a digital camera 91. In particular, FIG. 36A shows an example of an appearance of the front face side, that is, the image pickup object side, and FIG. 36B shows an example of an appearance of the rear face side, that is, the image pickup person side, of the digital camera 91.

Referring to FIGS. 36A and 36B, the digital camera 91 shown includes a protective cover 93, an image pickup lens section 95, a display screen 97, a control switch 99 and a shutter button 101. The display screen 97 corresponds to the display panel 73.

Figure 37:
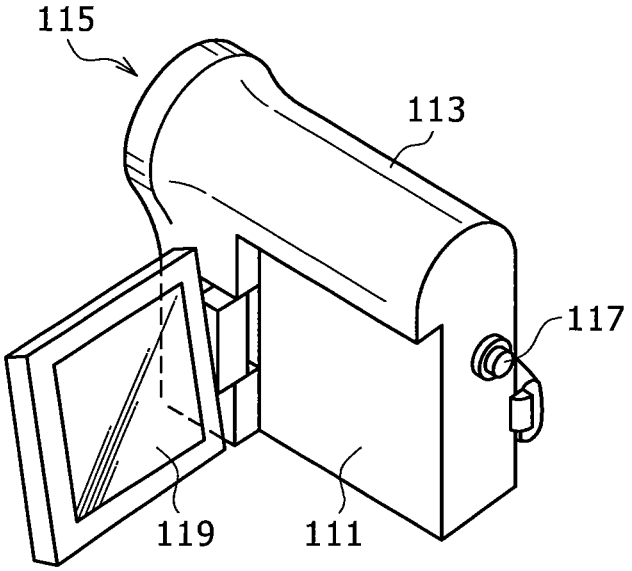

The electronic apparatus 71 may otherwise have a form of, for example, a video camera. FIG. 37 shows an example of an appearance of a video camera 111.

Referring to FIG. 37, the video camera 111 shown includes a body 113, and an image pickup lens 115 for picking up an image of an image pickup object, a start/stop switch 117 for image pickup and a display screen 119, provided at a front portion of the body 113. The display screen 119 corresponds to the display panel 73.

Figure 38A:
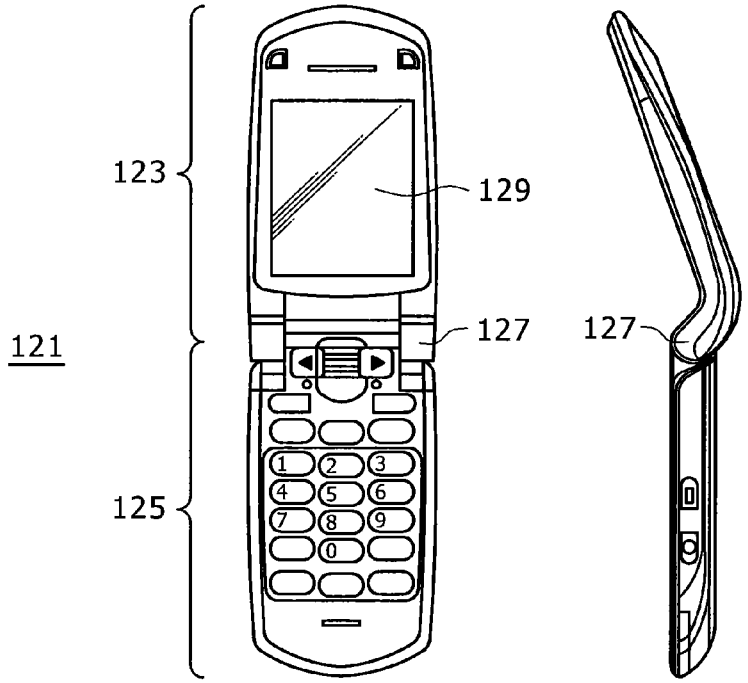
Figure 38B:
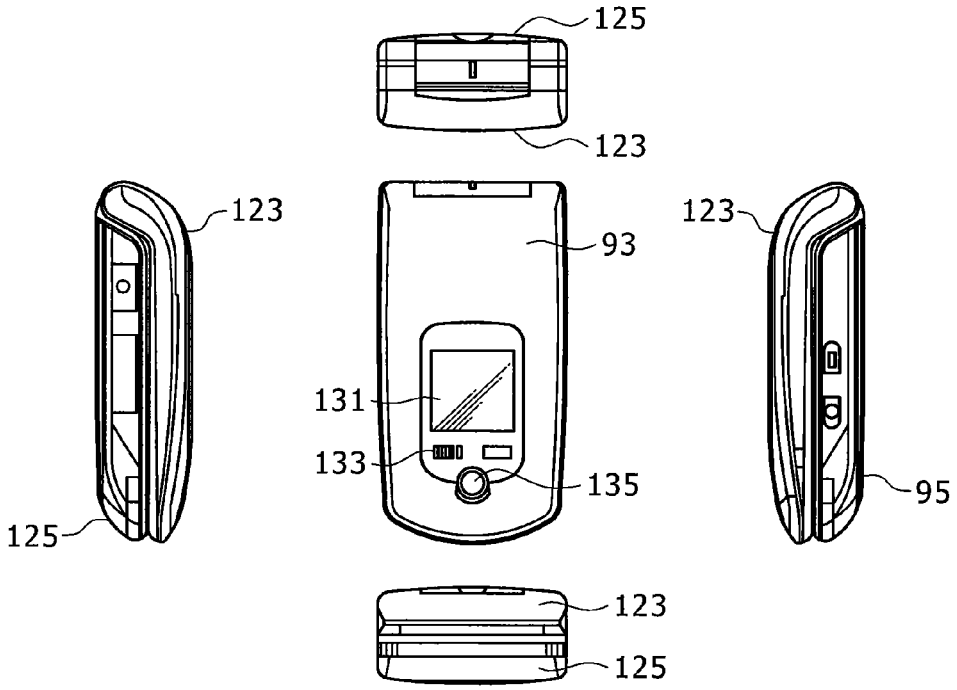

The electronic apparatus 71 may alternatively have a form of, for example, a portable terminal apparatus. FIGS. 38A and 38B show an example of an appearance of a portable telephone set 121 as a portable terminal apparatus. Referring to FIGS. 38A and 38B, the portable telephone set 121 shown is of the foldable type, and FIG. 38A shows an example of an appearance of the portable telephone set 121 in a state wherein a housing thereof is unfolded while FIG. 38B shows an example of an appearance of the portable telephone set 121 in another state wherein the housing thereof is folded.

The portable telephone set 121 includes an upper side housing 123, a lower side housing 125, a connection section 127 in the form of a hinge section, a display screen 129, a sub display screen 131, a picture light 133 and an image pickup lens 135. The display screen 129 and the sub display screen 131 correspond to the display panel 73.

Figure 39:
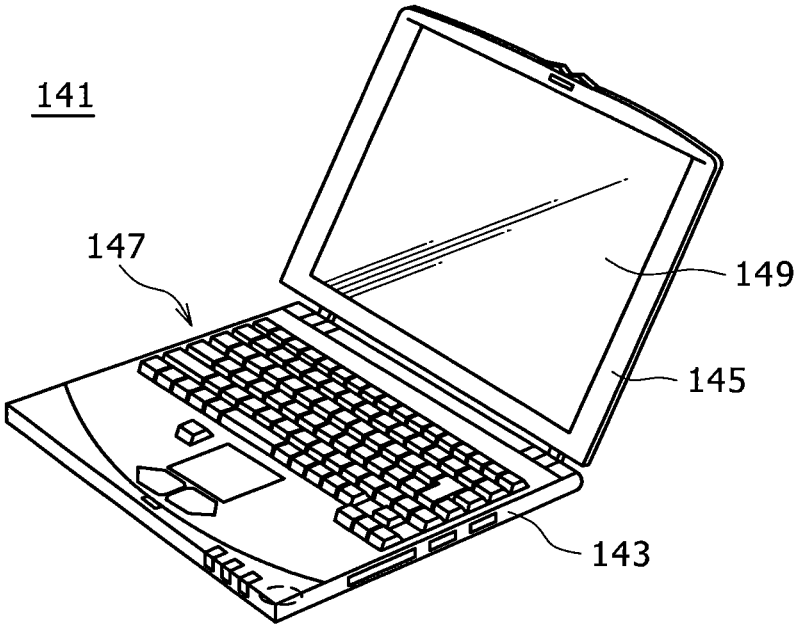

The electronic apparatus 71 may otherwise have a form of, for example, a computer. FIG. 39 shows an example of an appearance of a notebook type computer 141.

Referring to FIG. 39, the notebook type computer 141 shown includes a lower side housing 143, an upper side housing 145, a keyboard 147 and a display screen 149. The display screen 149 corresponds to the display panel 73.

The electronic apparatus 71 may otherwise have various other forms such as an audio reproduction apparatus, a game machine, an electronic book and an electronic dictionary.

C-5. Other Examples of Pixel Circuit

Figure 2:
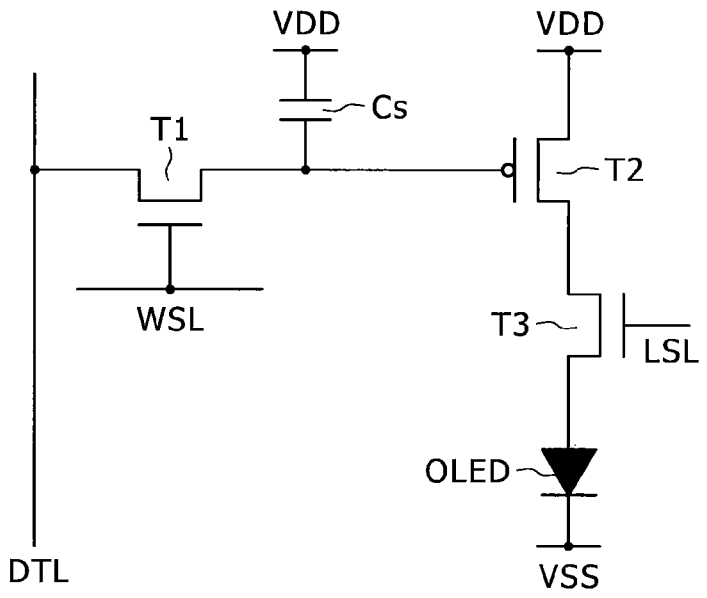
FIGS. 2 and 3 are circuit diagrams showing different examples of a pixel circuit used in an organic EL panel of the active matrix driving type.
Figure 3:
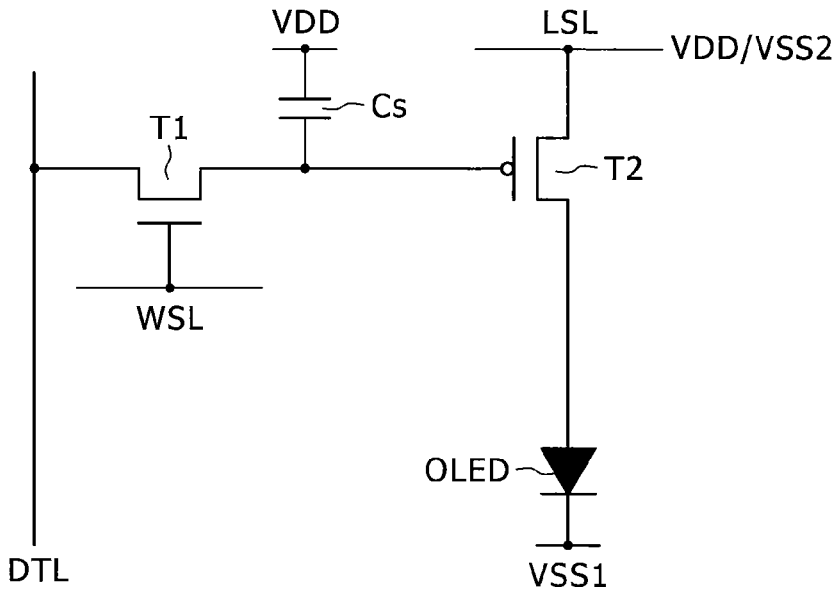
Figures 4A, 4B, 4C:
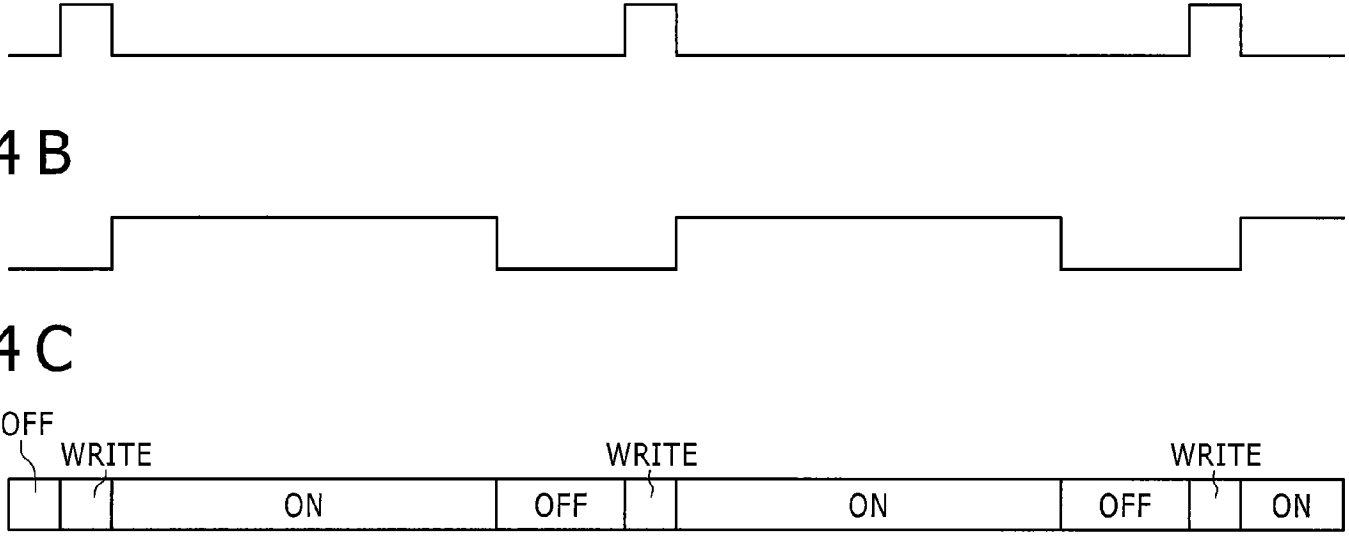
FIG.4C RELATED ART
FIGS. 4A to 4C and 5A to 5C are timing charts illustrating different examples of driving operation wherein a one-field period includes one light emitting period (related art)
Figures 5A, 5B, 5C:
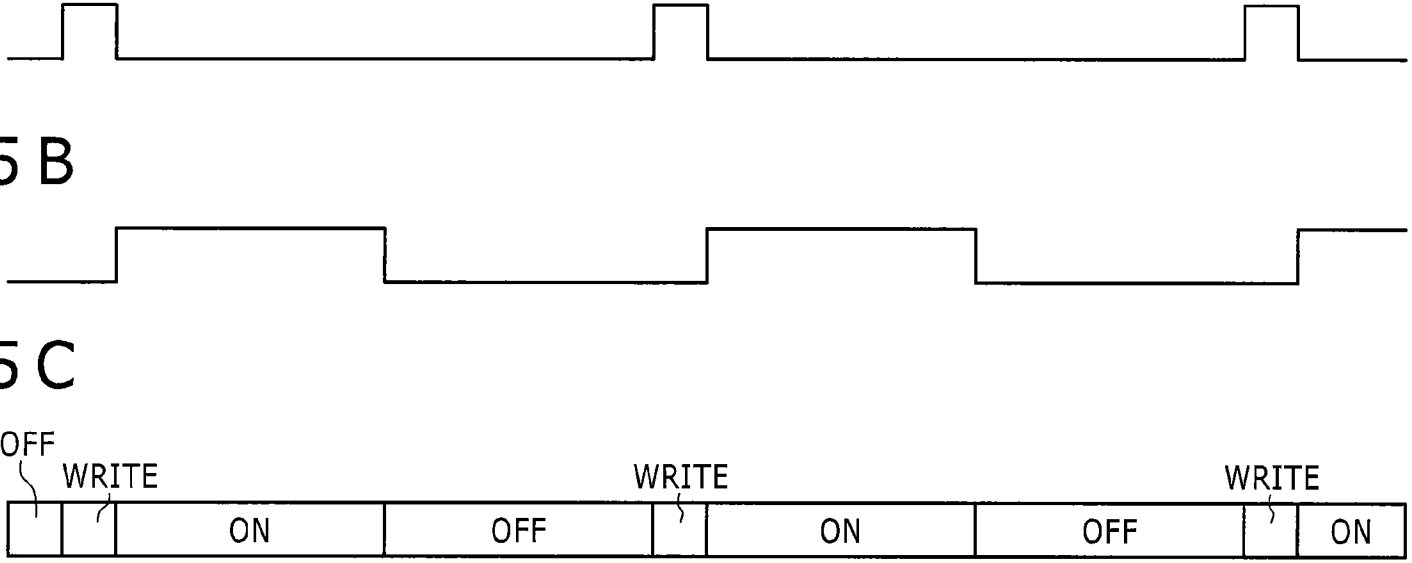
FIG.5C RELATED ART
Figure 6:
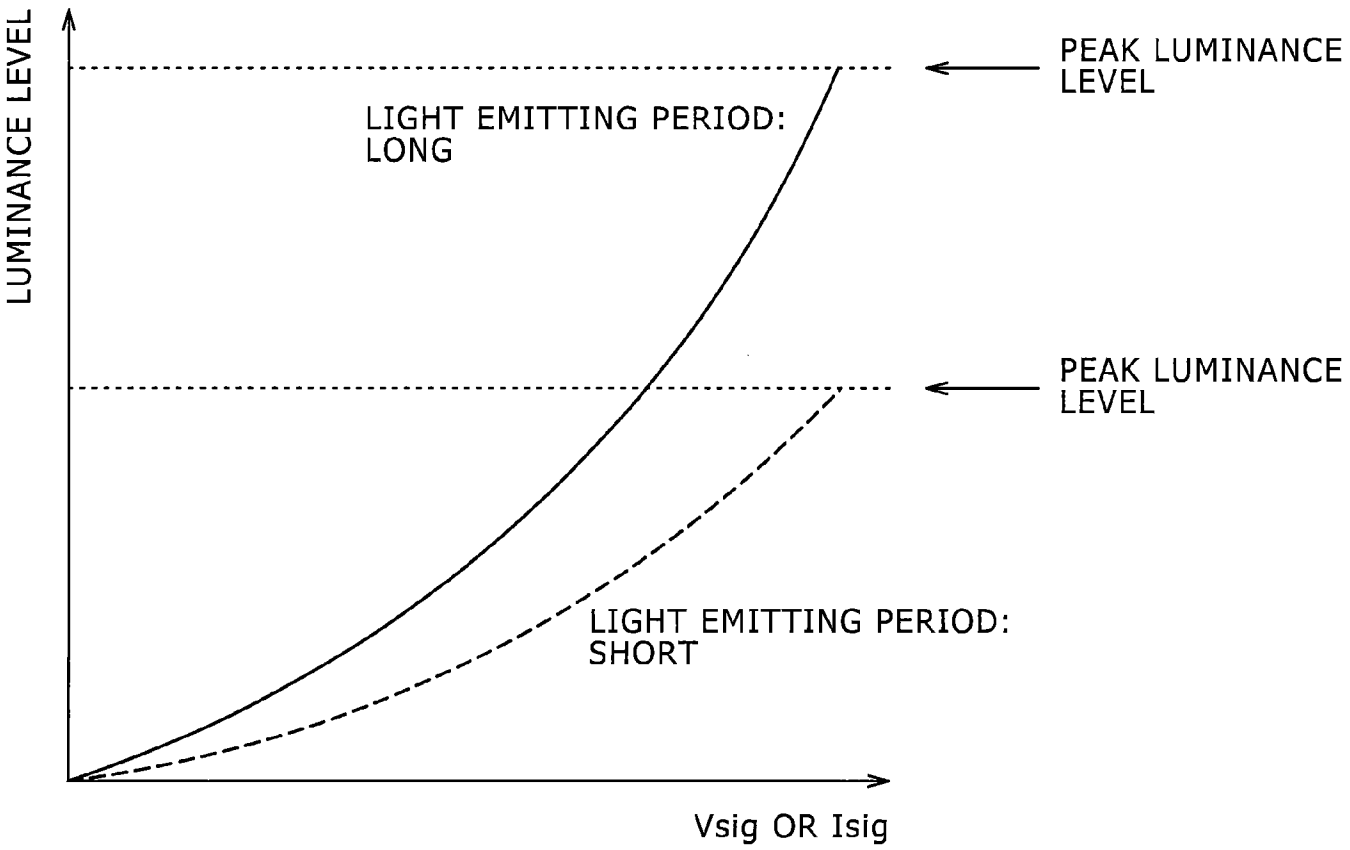
FIG. 6 is a graph illustrating a relationship between the light emitting period length and the peak luminance level.
Figure 7:
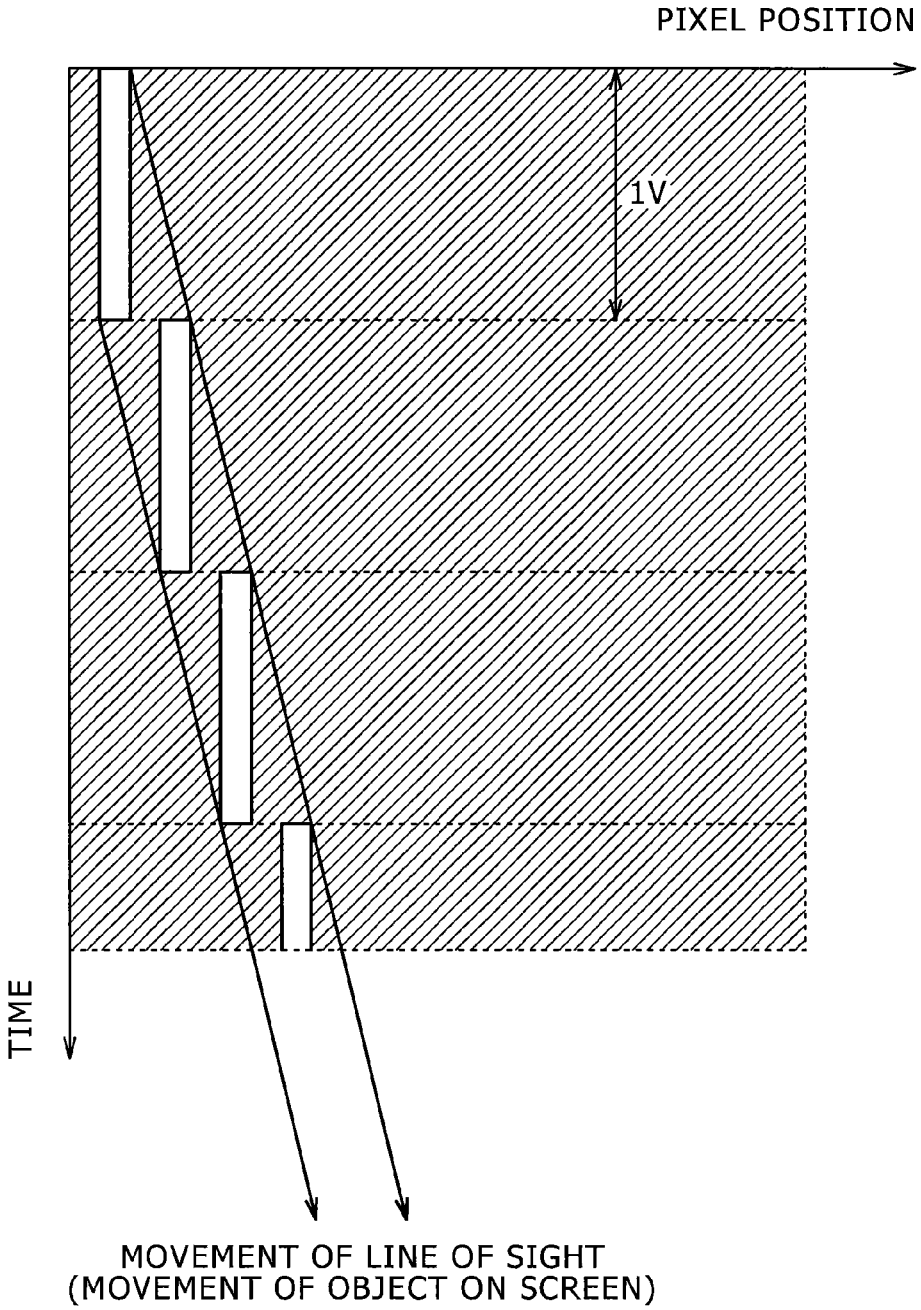
FIGS. 7 to 9 are diagrammatic views illustrating different relationships between the light emitting period and the movement of a viewpoint.
Figure 8:
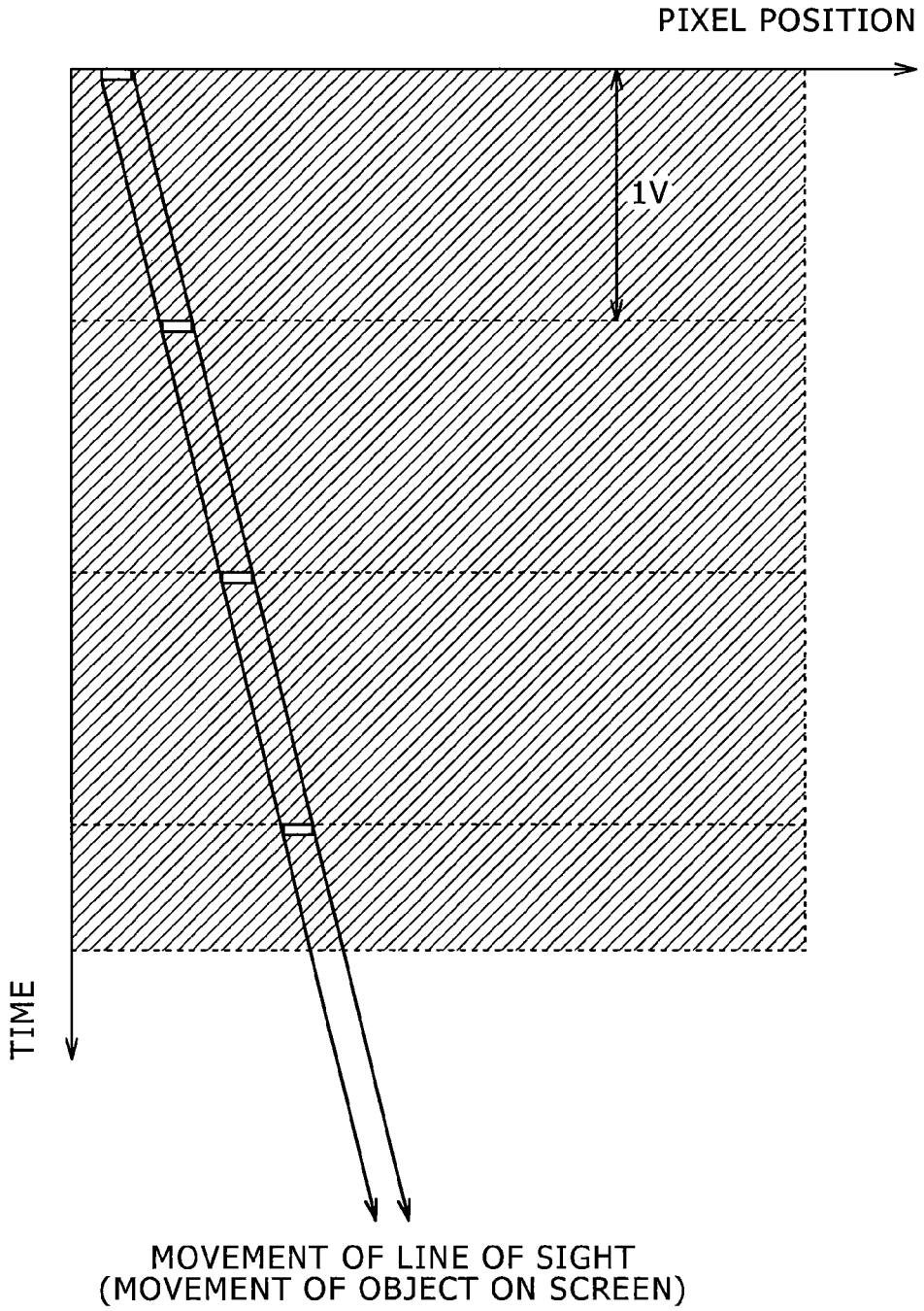
Figure 9:
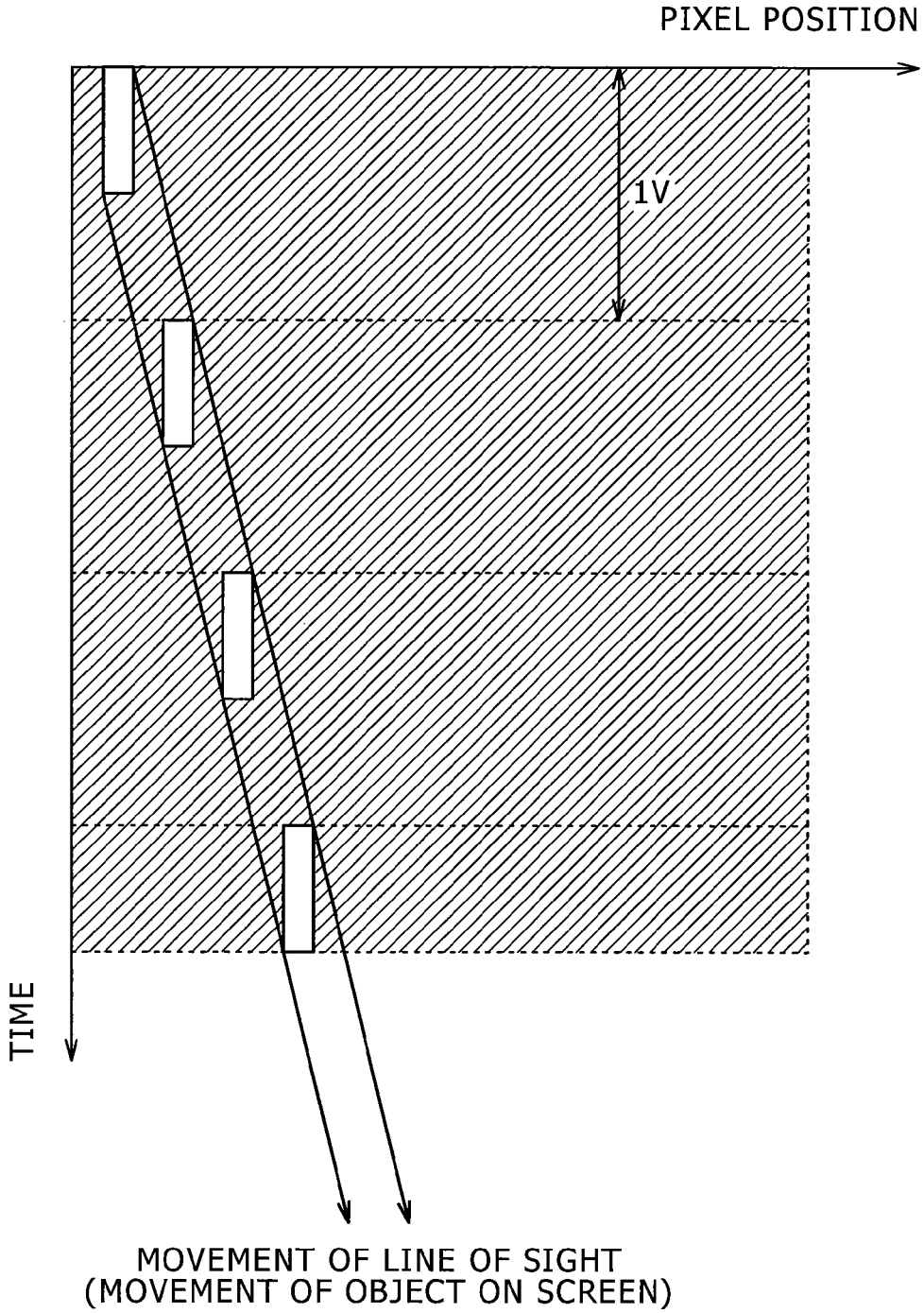
Figure 10:
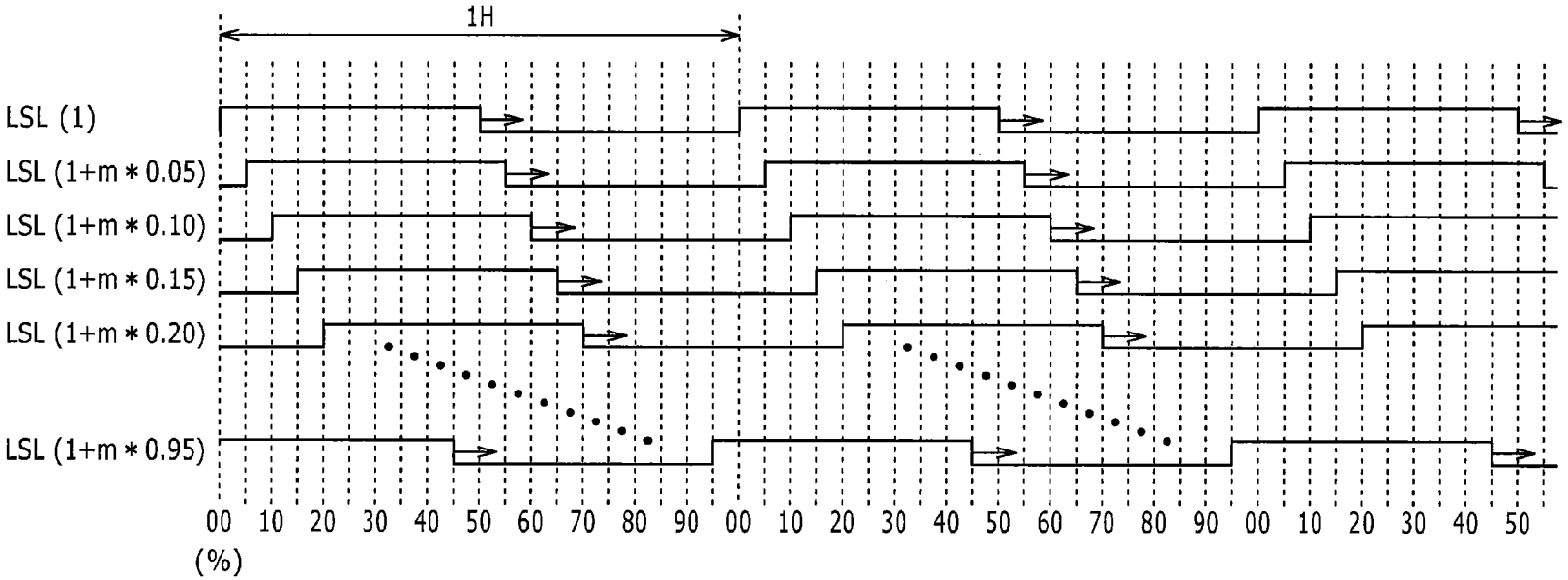
FIG. 10 is a timing chart illustrating an example of driving timings in related art where a light emitting period length of 50% of a one-field period is provided in a one-light emitting period.
Figure 11:
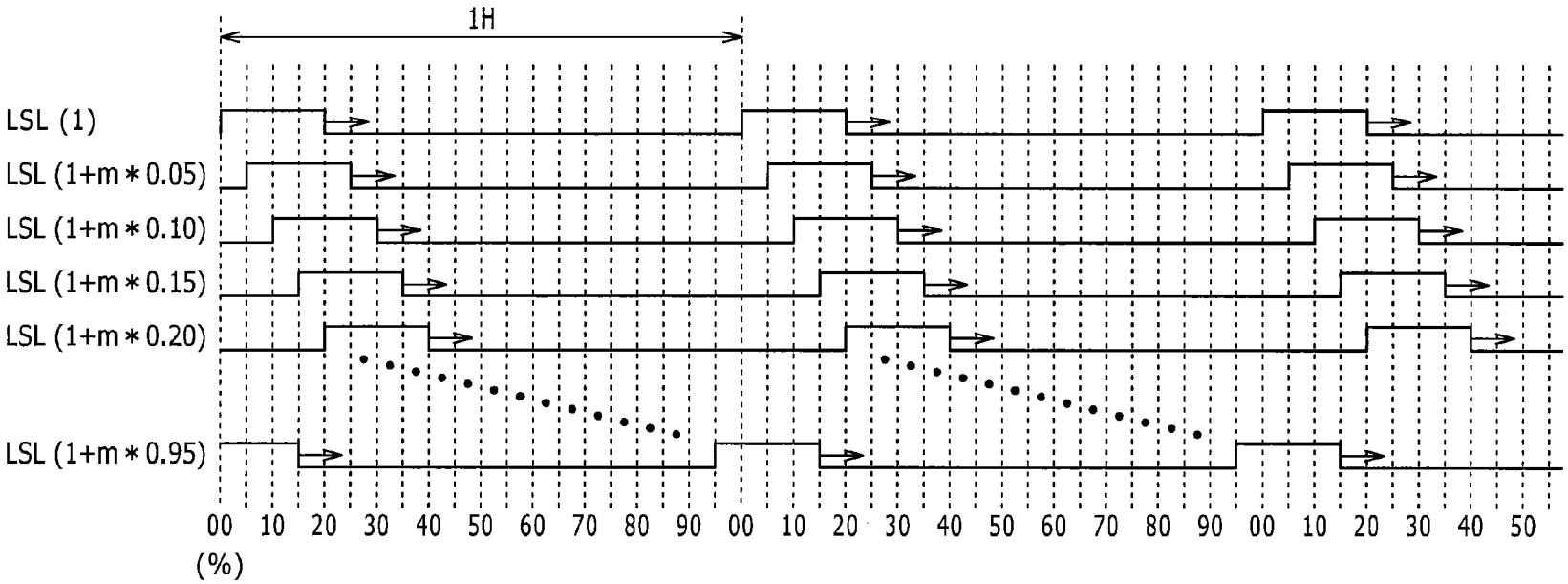
FIG. 11 is a timing chart illustrating an example of driving timings in related art where a light emitting period length of 20% of a one-field period is provided in a one-light emitting period.
Figure 12A:
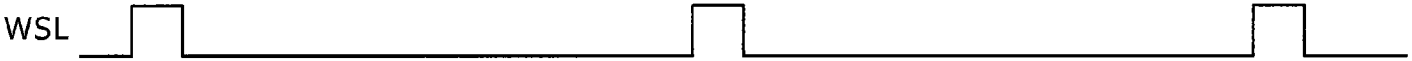
FIGS. 12A to 12C and 13 are timing charts illustrating an example of driving operation in related art wherein a one-field period includes two light emitting periods are involved.
Figure 12B:
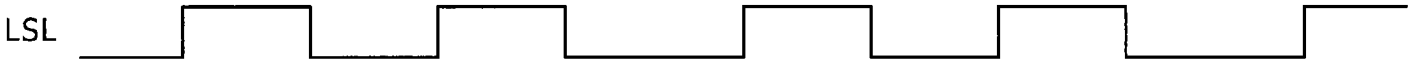
Figure 12C:
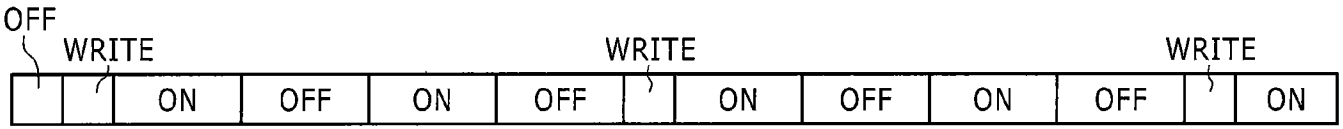
Figure 13:
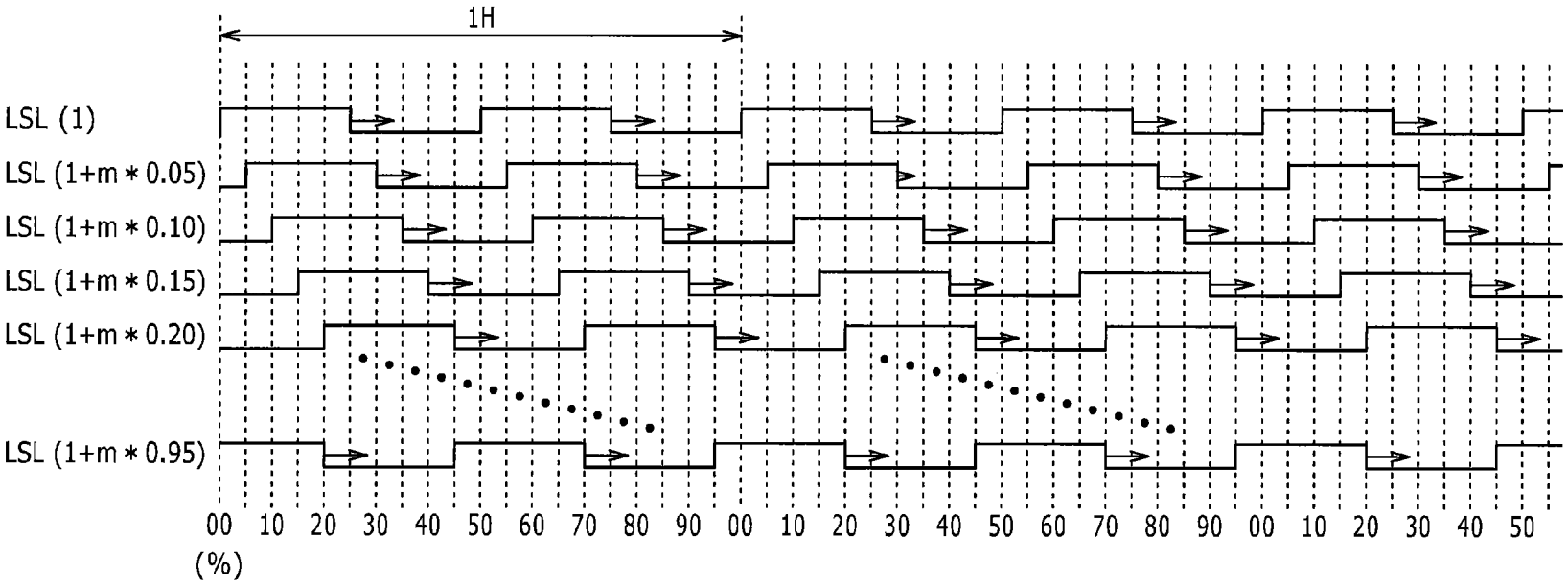
Figure 14:
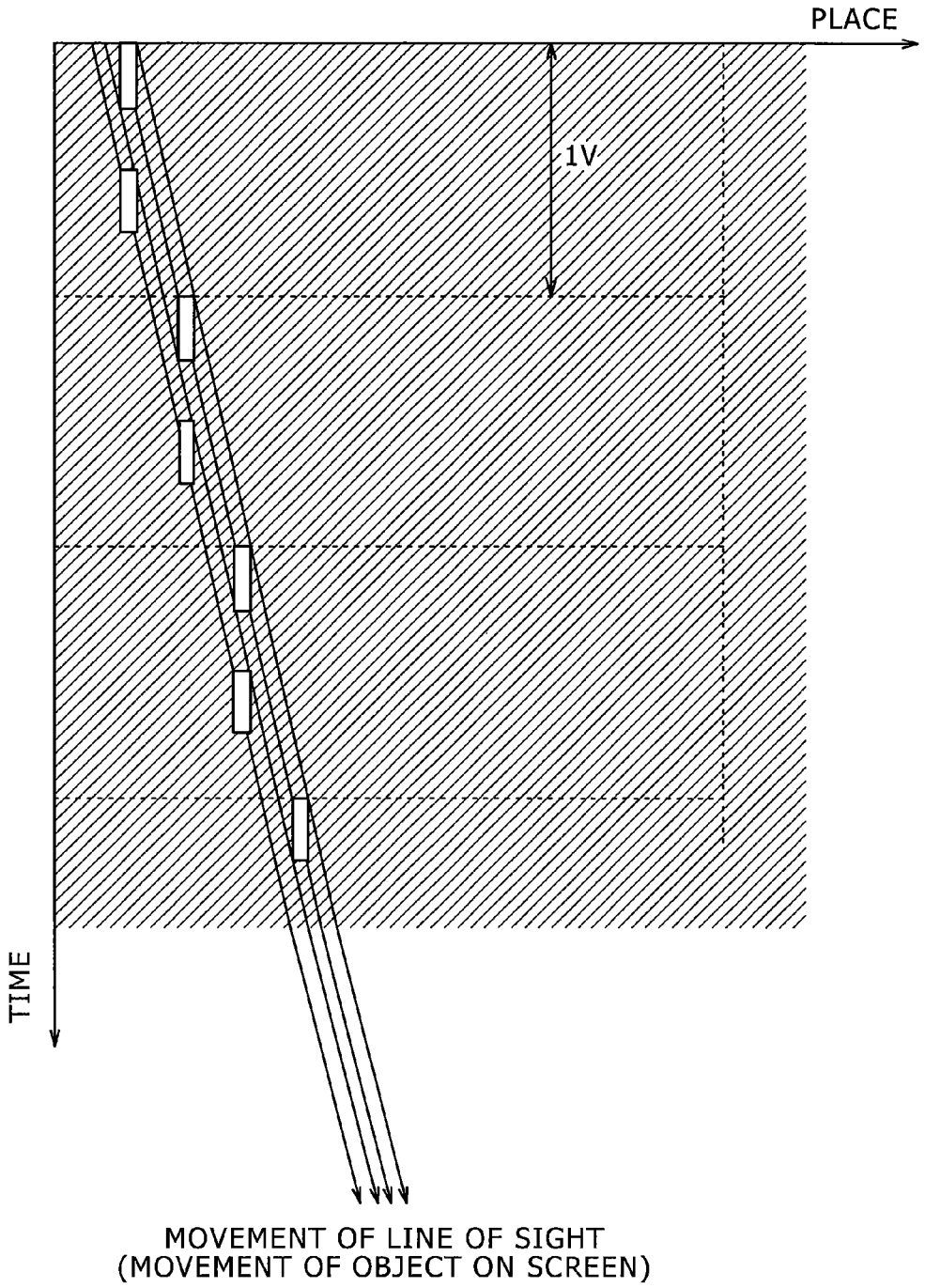
FIG. 14 is a view illustrating a further relationship between the light emitting period length and the movement of a viewpoint in related art.

In the foregoing description, examples of a pixel circuit of the active matrix driving type (FIGS. 2 and 3) are described.

However, the configuration of the pixel circuit is not limited to this, but the present invention can be applied also to pixel circuits of various existing configurations or various configurations which may be proposed in the future.

C-6. Others

The embodiments described above may be modified in various manners without departing from the spirit and scope of the present invention. Also various modifications and applications may be created or combined based on the disclosure of the present invention.

What is claimed is:

1. A display device wherein the peak luminance level in each of a plurality of one-field periods is variably controlled through control of respective arrangements of light emitting periods in the plurality of one-field periods, the display device comprising:

light emitting period setting circuitry configured to variably set, in each one field period, period lengths of N light emitting periods that are arranged in the respective one-field period, in response to a total light emitting period length for the respective one-field period, where N is an even integer and N ≥3, wherein the N light emitting periods are merged into a single light emitting period when the total light emitting period length reaches a maximum value therefor.

2. The display device according to claim 1, wherein, in each of the plurality of one-field periods, the beginning of a first one of the N light emitting periods is fixed.

3. The display device according to claim 1, wherein, in each of the plurality of one-field periods, the end of a last one of the N light emitting periods is fixed.

4. The display device according to claim 1, wherein, in each of the plurality of one-field periods, the beginning of a first one of the N light emitting periods and the end of a last one of the N light emitting periods are fixed.

5. A display device comprising:

a plurality of pixels; and light emitting period setting circuitry configured to variably set, in each one field period, period lengths of N light emitting periods that are arranged in the respective one-field period, in response to a total light emitting period length for the respective one-field period, where N is an even integer and N ≥3, wherein each of the plurality of pixels is configured to emit light according to the period set by the light emitting period setting circuitry, and wherein the N light emitting periods are merged into a single light emitting period when the total light emitting period length reaches a maximum value therefor.

6. The display device according to claim 1, wherein each of the plurality of pixels includes a light emitting element, a driving transistor, a sampling transistor, a switching transistor, and a capacitor, wherein the driving transistor is configured to control a drive current according to a data voltage stored in the capacitor, and wherein the switching transistor connected between the driving transistor and the light emitting element drive current is configured to switch the drive current according to a pulse signal supplied from the light emitting period setting circuitry.

7. The display device according to claim 6, wherein, in each of the plurality of one-field periods, the beginning of a first one of the N light emitting periods is fixed.

8. The display device according to claim 6, wherein, in each of the plurality of one-field periods, the end of a last one of the N light emitting periods is fixed.

9. The display device according to claim 6, wherein, in each of the plurality of one-field periods, the beginning of a first one of the N light emitting periods and the end of a last one of the N light emitting periods are fixed.

* * * * *